US011384530B2

(12) United States Patent
Brown et al.

(10) Patent No.: US 11,384,530 B2
(45) **Date of Patent: *Jul. 12, 2022**

(54) VAULT FOR ACTIVE SHOOTERS AND TORNADOES

(71) Applicant: Big 6, LLP, Campobello, SC (US)

(72) Inventors: James C. Brown, Campobello, SC (US); James R. Byrd, Landrum, SC (US); Jeffery L. Carson, Enterprise, AL (US); John M. Evans, Campobello, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/934,252

(22) Filed: Jul. 21, 2020

(65) Prior Publication Data

US 2021/0102365 A1 Apr. 8, 2021

Related U.S. Application Data

(63) Continuation of application No. 15/963,156, filed on Apr. 26, 2018, now Pat. No. 10,738,459.

(60) Provisional application No. 62/491,339, filed on Apr. 28, 2017.

(51) Int. Cl.

| | |
|---|---|
| ***E04B 1/344*** | (2006.01) |
| ***E04H 9/14*** | (2006.01) |
| ***E04H 9/06*** | (2006.01) |
| ***F41H 5/24*** | (2006.01) |
| ***E04H 9/10*** | (2006.01) |
| *E04B 1/343* | (2006.01) |

(52) U.S. Cl.

CPC ..... *E04B 1/3445* (2013.01); *E04H 9/06* (2013.01); *E04H 9/10* (2013.01); *E04H 9/14* (2013.01); *F41H 5/24* (2013.01); *E04B 2001/34389* (2013.01)

(58) Field of Classification Search

CPC ..... E04B 1/3444; E04B 1/3445; E04B 2001/34389; E04H 9/06; E04H 9/10; E04H 9/14; E04H 15/38; E04H 15/48; F41H 5/24; Y02A 50/00

See application file for complete search history.

(56) References Cited

U.S. PATENT DOCUMENTS

| | | | | |
|---|---|---|---|---|
| 2,120,861 A | 6/1938 | Hastings | E04H 15/34 | 52/262 |
| 2,647,287 A | 8/1953 | Jones | E04B 1/6183 | 52/582.2 |
| 2,838,592 A | 6/1958 | Feketics | H05K 9/0001 | 174/371 |

(Continued)

FOREIGN PATENT DOCUMENTS

| | | |
|---|---|---|
| DE | 20320217 | 4/2004 |
| WO | WO9613402 | 5/1996 |

OTHER PUBLICATIONS

Amethyst Holmes: Small business creates collapsible safe room for classrooms, homes http://www.al.com/news/huntsville/index.ssf/2014/09/small_business_creates_collaps.html.

(Continued)

*Primary Examiner* — James M Ference

(74) *Attorney, Agent, or Firm* — Burr & Forman LLP; Douglas L. Lineberry

(57) ABSTRACT

The present disclosure relates to a protective enclosure to secure occupants against external threats, such as ballistic projectiles, blasts, or natural phenomena.

18 Claims, 21 Drawing Sheets

(56) References Cited

U.S. PATENT DOCUMENTS 2,963,122 A 12/1960 Jagemann ..... G07F 19/201 52/66
3,271,065 A 9/1966 Scuris ..... B60P 3/34 296/172
3,280,796 A 10/1966 Hatcher ..... A01K 1/033 119/499
3,341,987 A 9/1967 Ragnhill ..... E04B 1/3445 52/70
3,462,891 A 8/1969 Smith ..... E04B 1/3444 52/18
3,653,165 A 4/1972 West ..... E04B 1/3442 52/67
3,827,198 A 8/1974 Geihl ..... E04B 1/3442 52/69
3,849,952 A 11/1974 Hanaoka ..... E04L 1/3445 52/79.5
3,866,365 A 2/1975 Honigman ..... E04B 1/3444 52/70
4,035,964 A 7/1977 Robinson ..... E04B 1/3445 52/66
4,478,467 A 10/1984 Tyndall ..... A47B 43/00 211/87.01
4,545,171 A 10/1985 Colvin ..... E04B 1/3442 52/71
4,742,653 A 5/1988 Napier ..... E04B 1/3445 52/66
4,779,514 A 10/1988 Prigmore ..... E04B 1/3445 52/79.5
4,780,996 A 11/1988 Julien, Jr. ..... E04B 1/3444 52/68
4,979,242 A 12/1990 Maggio ..... E04H 1/1244 135/901
4,989,379 A 2/1991 Suzuki ..... E04B 1/3442 52/66
5,345,730 A 9/1994 Jurgensen ..... E04B 1/3444 52/64
5,493,818 A 2/1996 Wilson ..... E04B 1/3445 52/71
5,596,844 A 1/1997 Kalinowski ..... E04B 1/3442 52/122.1
5,706,846 A 1/1998 Sutton ..... A62B 13/00 135/128
5,950,373 A 9/1999 von Hoff ..... E02D 27/01 206/321
5,966,956 A 10/1999 Morris ..... F25D 11/003 52/69
6,223,479 B1 5/2001 Stockli ..... E04L 1/3442 52/126.1
6,243,992 B1 6/2001 Gyllenhammar ..... B60P 3/34 296/26.05
6,253,500 B1 7/2001 Gyllenhammar ..... E04B 1/3442 52/121
6,308,466 B1 10/2001 Moriarty ..... E04H 9/14 52/79.5
6,345,471 B1 2/2002 Gyllenhammar ..... E04B 1/3444 296/169
6,601,598 B2 8/2003 Clee ..... A01G 9/16 135/143
D496,737 S 9/2004 Moon ..... D25/33
6,983,567 B2 1/2006 Ciotti ..... E04B 1/3442 52/64
7,117,645 B2 10/2006 Bzorgi ..... E04B 1/3442 52/79.5
7,600,348 B1 10/2009 Kostka ..... E04H 9/10 135/97
7,841,136 B2 11/2010 Czyznikiewicz ..... E04B 1/3444 52/64
7,882,659 B2 2/2011 Gyory ..... E04B 1/3444 296/182.1
7,931,164 B2 4/2011 Krohn ..... B65D 88/522 220/1.5
D650,092 S 12/2011 Lucht ..... D25/33
8,166,715 B2 5/2012 De Azambuja ..... B60P 3/34 52/79.5
8,201,362 B2 6/2012 Alford ..... E04B 1/3442 52/64
8,286,391 B2 10/2012 Yang ..... E04B 1/3444 52/64
8,561,358 B2 10/2013 Rowan ..... E04H 1/1205 52/79.1
8,613,166 B2 12/2013 Smith ..... E04B 1/3445 52/122.1
8,613,242 B2 12/2013 Peters ..... F41H 5/24 89/36.02
8,615,967 B1 12/2013 Figovsky ..... E04B 1/164 52/641
8,938,917 B1 1/2015 Bernardy ..... E04H 3/08 52/169.6
8,978,318 B2 3/2015 Klein ..... F41H 5/24 52/69
9,121,188 B2 9/2015 von Bereghy ..... A47B 13/02
9,228,369 B2 1/2016 Carberry ..... E04H 9/10
9,376,829 B2 6/2016 King, III ..... E04H 9/14
9,394,713 B1 * 7/2016 Chen ..... E04H 9/14
10,738,459 B2 * 8/2020 Brown ..... E04H 15/48
2004/0050008 A1 3/2004 Mintie ..... B08B 15/00 52/646
2004/0206015 A1 10/2004 Greenboim ..... E04H 9/10 52/79.1
2005/0044804 A1 3/2005 Bin ..... E04L 1/3445 52/79.5
2006/0000177 A1 1/2006 Salzano ..... E04B 1/34321 52/474
2008/0142059 A1 6/2008 Bonebrake ..... B60P 3/34 135/88.1
2008/0256767 A1 10/2008 Berns ..... E04B 1/3444 27/35
2008/0256878 A1 10/2008 Berns ..... E04L 1/3444 52/79.6
2009/0014044 A1 1/2009 Hartman ..... E04B 1/3445 135/143
2010/0025397 A1 2/2010 Krohn ..... B65D 88/12 220/6
2010/0043308 A1 2/2010 Keeble ..... E04B 1/34321 52/79.1
2010/0218453 A1 9/2010 Gibson ..... E04B 1/3444 52/745.1
2011/0056146 A1 3/2011 Appert ..... B60P 3/34 52/79.1
2011/0259768 A1 10/2011 Campbell ..... E04B 1/3444 206/216
2012/0090455 A1 4/2012 Duncan ..... E04H 9/10 89/36.07
2012/0180404 A1 7/2012 Scouten ..... E04H 9/14 52/79.5
2012/0186166 A1 7/2012 Casto ..... E04B 1/3445 52/79.5
2012/0285104 A1 11/2012 Digregory ..... E04B 1/3445 52/79.5
2012/0311939 A1 12/2012 Barragan Olaya ..... E04B 1/344 52/79.5
2012/0317898 A1 12/2012 Strachan ..... E04B 1/3445 52/79.5
2013/0019913 A1 1/2013 Zadok ..... E04B 1/3442 135/96
2013/0067846 A1 3/2013 Kvols ..... E04H 1/1205 52/586.1
2013/0091783 A1 4/2013 Reinmann, Jr. ..... A62B 31/00 52/79.5
2013/0192147 A1 8/2013 Schaffert ..... E04B 1/344 52/79.5
2013/0291449 A1 11/2013 Strickland ..... E04B 1/3442 52/79.5
2014/0000183 A1 1/2014 Perren ..... E04H 1/005 52/79.5
2014/0047778 A1 2/2014 Digregory ..... E04B 1/34384 52/2.25

(56) References Cited

U.S. PATENT DOCUMENTS

2014/0090312 A1 4/2014 Medley ..... E04B 1/34357 52/79.5
2014/0116870 A1 5/2014 Kamen ..... E04H 1/1205 202/83
2014/0137483 A1 5/2014 Tong ..... E04H 1/12 52/2.11
2014/0157685 A1 6/2014 Fagan ..... E04H 1/12 52/79.5
2014/0202089 A1 7/2014 Nakajima ..... E04B 1/3444 52/79.5
2014/0259976 A1 9/2014 Bowers ..... E04H 9/14 52/79.5
2014/0311051 A1 10/2014 Fagan ..... E04B 1/3444 52/79.5
2015/0121776 A1 5/2015 Peterson ..... E04B 1/3445 52/79.5
2015/0218794 A1 8/2015 Martyn ..... E04B 1/3441 52/79.5
2015/0246699 A1 9/2015 Anabtawi ..... B60D 1/06 280/511
2015/0267396 A1 9/2015 Cantin ..... E04B 1/34305 52/79.5
2015/0315776 A1 11/2015 Duncan ..... A01G 9/14 52/66
2015/0345168 A1 12/2015 Wirtz ..... E04H 1/1205 52/79.9
2016/0090731 A1 3/2016 Thrall ..... E04B 1/34384 52/79.5
2016/0102740 A1 4/2016 Martyn ..... E04B 1/3441 52/69
2017/0159316 A1 6/2017 Soukos ..... E04H 9/06
2017/0314255 A1 11/2017 Klein ..... E04B 1/3444
2017/0356182 A1 12/2017 Caffaratti Giro ..... E04B 1/8218
2018/0313074 A1 11/2018 Brown ..... E04B 1/3445
2021/0102365 A1* 4/2021 Brown ..... E04H 9/06

OTHER PUBLICATIONS http://www.big6lip.com/.

* cited by examiner

VAULT FOR ACTIVE SHOOTERS AND TORNADOES

BACKGROUND OF THE INVENTION

1) Field of the Invention

The present disclosure relates to a protective enclosure to secure occupants against external threats, such as ballistic projectiles, blasts, or natural phenomena.

2) Description of Related Art

Prior attempts at devising ballistic shelters are known. For instance, U.S. Pat. Pub. No. 2012/0090455, ("Duncan 3 455"), provides a lightweight, portable ballistic panel integrated into a shelter. In this structure, wall segments or panels of ballistic material are provided and hang from an interior or exterior frame associated with the structure. The panels may fold and may be comprised of a welded together combination of an outer shell and an inner ballistic-resistant material. (Abstract.) FIG. 1 illustrates the Duncan '455 invention.

U.S. Pat. No. 8,561,358 discloses emergency housing for short term and longer-term purposes. The shelter may be transported to a site and erected in less than an hour. The shelter may provide food, supplies, shelter and necessary essentials. (Abstract.)

U.S. Pat. Pub. No. 2004/0206015 ("Greenbolm '015") discloses an above ground shelter that comprise a modular interface which includes a connecting element and a passageway for connection and passage to another above ground shelter. (Abstract.)

U.S. Pat. No. 6,601,598 ("Clee '598") discloses a collapsible shelter with pleated wall, floor, and roof sections that will allow the shelter to collapse in an accordion style. (Abstract.) FIG. 2 illustrates the Clee '598 invention.

U.S. Pat. No. 9,228,369 ("Carberry '369") discloses a portable protection system that includes a selectively collapsible truss that supports a protection member. The truss may move between a collapsed and expanded position. The protection member includes at least one layer of ballistic armor material for disrupting a projectile. (Abstract.) The Carberry '369 invention is essentially a ballistic shield placed in the path of a projectile to prevent damage to property and personnel.

U.S. Pat. Pub. 2015/0267396 (Cantin '396) discloses a shelter having the approximate dimensions of a standard International Organization for Standardization (ISO) freight container. The shelter may be expanded by adding additional portions to the front and sides of the container. (Abstract.)

U.S. Pat. Pub. 2015/0345168 (Wirtz '168) discloses an above ground storm shelter having sidewalls comprised of two panels, an outer panel and an inner panel. Sounds of articles striking the sidewalls during a storm are lessened by the double panel configuration. The double panel configuration also provides improved structural integrity compared to single panel structures. The sidewalls are modular and variable sized structures may be constructed using multiple panels. (Abstract.)

U.S. Pat. No. 4,979,242 (Maggio '242) discloses a collapsible portable shelter, or changing room, comprising a circular bellows like configuration. The bellows-like walls overlap vertically and integrally down the side around a large aperture in a spring-like manner from tension on the rib folds by manual downward pressure. The wall is accordion-like and, when fully collapsed, substantially fits within an optional carry case that may be fastened to a shelter floor. Releasing fasteners cause the bellows walls to spring upward from the case. The interior is sufficient in size to enclose a person for a toilet shelter or changing room. (Abstract.)

U.S. Pat. No. 6,308,466 (Moriarty '466) discloses a temporary portable shelter for use in hurricanes and tornadoes. The enclose consists of a case having six sides, a hinged door, and is constructed of polycarbonate thermoplastic. The enclosure may be bolted to a floor to secure it. (Abstract.)

While the above references disclose various types of shelters, what is needed in the art is a collapsible structure that may be quickly expanded with minimal effort to create a secure area impervious to attack and storm damage. Accordingly, it is an object of the present invention to provide an expandable and collapsible shelter that may be quickly expanded to establish a protective enclosure.

SUMMARY OF THE INVENTION

In one embodiment, a protective shelter is provided. The shelter moves reversibly between a closed configuration and an open configuration. The shelter in the open configuration includes at least two side walls formed from at least two joined side wall sections, at least one roof formed from at least two joined roof sections; at least one floor formed from at least one floor section, at least one back panel, at least one front panel defining an entry access, and wherein weight of the at least one roof assists with opening the shelter.

In a further embodiment, the protective shelter includes at least one hydraulic damper to reduce an opening force associated with moving the protective shelter from the closed configuration to the open configuration. Still further, the protective shelter includes at least one spring assist device that applies forces to at least the front panel to assist the protective shelter moving from the closed configuration to the open configuration. Further yet, the protective shelter the at least the two side walls, back panel, and front panel are formed from ballistic material. Further yet still, at least one floor plate is affixed to a floor supporting the protective shelter and the at least one floor plate is affixed to the at least one back panel. Still further yet, the at least two joined side wall sections are joined via hinges. Even further, the at least two joined side wall sections extend and retract via movement of rollers or ball assemblies affixed to the joined wall sections. Furthermore, the rollers or ball assemblies move in an arcuate manner atop the at least one floor plate. Further still, a cabinet may be affixed to the at least one back panel. Even still further, the cabinet includes at least a communications console for allowing occupants of the protective shelter to communicate externally. Further even still, multiple shelters are conjoined to form a single, larger protective shelter.

In an alternative embodiment, a method of providing a protective shelter for occupants in a room is provided. The method includes releasing a latch mechanism located on the protective shelter, a spring assist mechanism then provides additional force against at least one front panel of the protective shelter to move the front panel away from at least one back panel, a pulling force is applied to the front panel of the protective shelter, at least one roof panel of the protective shelter supplies additional force to propel the front panel outward and to extend at least two side walls of the protective shelter, the protective shelter expands from a closed configuration to an open configuration wherein the at least one roof panel and the at least two side walls are fully extended and the at least one front panel is separated from the at least one back panel.

Further, the protective shelter includes an entry in the front panel, which is opened to allow occupants to enter the protective configuration in an open configuration. Further still, the protective shelter includes at least one hydraulic damper to reduce an opening force associated with moving the protective shelter from the closed configuration to the open configuration. Still further, at least the two side walls, the at least one back panel, and the at least one front panel are formed from ballistic material. Still yet further, the at least two side walls extend and retract via movement of rollers or ball assemblies affixed to the at least two side walls. Further yet, the rollers or ball assemblies move in an arcuate manner atop a floor plate. Still yet further, a cabinet may be affixed to the at least one back panel. Further yet still, the cabinet includes at least a communications console for allowing occupants of the protective shelter to communicate externally.

BRIEF DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

Figure 1:
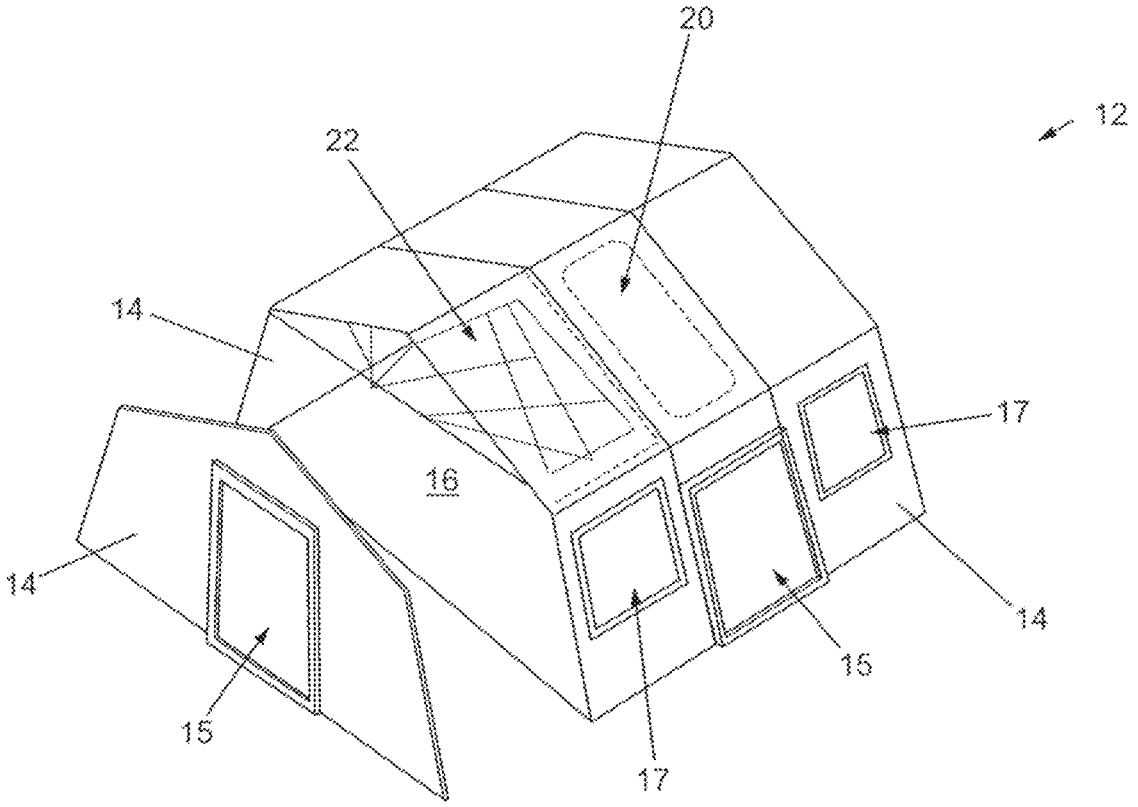
Figure 1 PRIOR ART
FIG. 1 shows a prior art shelter.
Figure 2:
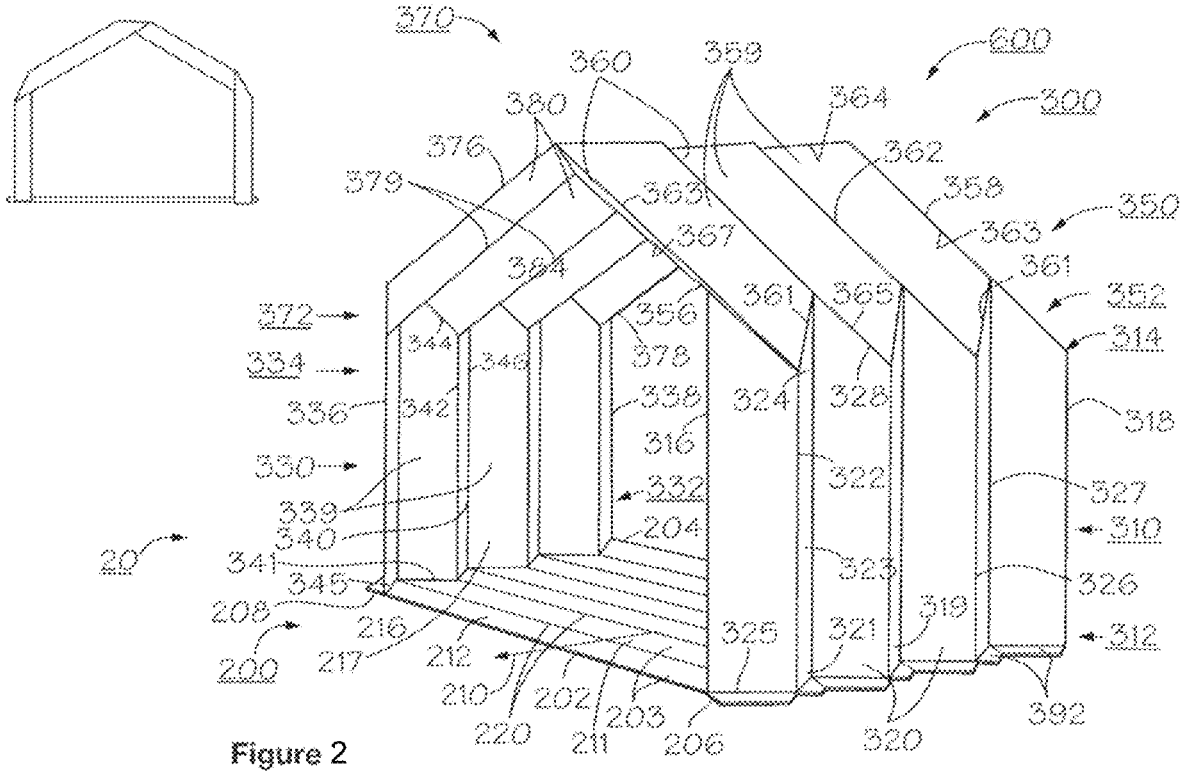
Figure 2 PRIOR ART
FIG. 2 shows an additional prior art shelter.

It will be understood by those skilled in the art that one or more aspects of this invention can meet certain objectives, while one or more other aspects can meet certain other objectives. Each objective may not apply equally, in all its respects, to every aspect of this invention. As such, the preceding objects can be viewed in the alternative with respect to any one aspect of this invention. These and other objects and features of the invention will become more fully apparent when the following detailed description is read in conjunction with the accompanying figures and examples. However, it is to be understood that both the foregoing summary of the invention and the following detailed description are of a preferred embodiment and not restrictive of the invention or other alternate embodiments of the invention. In particular, while the invention is described herein with reference to a number of specific embodiments, it will be appreciated that the description is illustrative of the invention and is not constructed as limiting of the invention. Various modifications and applications may occur to those who are skilled in the art, without departing from the spirit and the scope of the invention, as described by the appended claims. Likewise, other objects, features, benefits and advantages of the present invention will be apparent from this summary and certain embodiments described below, and will be readily apparent to those skilled in the art. Such objects, features, benefits and advantages will be apparent from the above in conjunction with the accompanying examples, data, figures and all reasonable inferences to be drawn therefrom, alone or with consideration of the references incorporated herein.

DETAILED DESCRIPTION OF A PREFERRED EMBODIMENT

With reference to the drawings, the invention will now be described in more detail. Unless defined otherwise, all technical and scientific terms used herein have the same meaning as commonly understood to one of ordinary skill in the art to which the presently disclosed subject matter belongs. Although any methods, devices, and materials similar or equivalent to those described herein can be used in the practice or testing of the presently disclosed subject matter, representative methods, devices, and materials are herein described.

Unless specifically stated, terms and phrases used in this document, and variations thereof, unless otherwise expressly stated, should be construed as open ended as opposed to limiting. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise.

Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

In one embodiment, the current disclosure provides a reversibly collapsible active shooter ballistic protection unit or a safe area from natural phenomena such as tornadoes. The unit may offer protection up to and exceeding the Underwriter's Laboratory Standard 752 Level 8, National Institute of Justice Standard 0108.01 Level 3 and F-5 Tornado protection from FEMA P-361 specifications. The size of the unit may be customized to accommodate specific rooms, such as a school room, open areas, historic rooms where protection is needed without demolishing the existing structure, etc. To wit, the unit may be sized, or multiple units conjoined or used separately, to allow the maximum occupancy of a room to seek shelter in case of an event. Operation of the unit may, in one embodiment, include unlatching the unit, pulling it open, and entering the unit.

Figure 3:
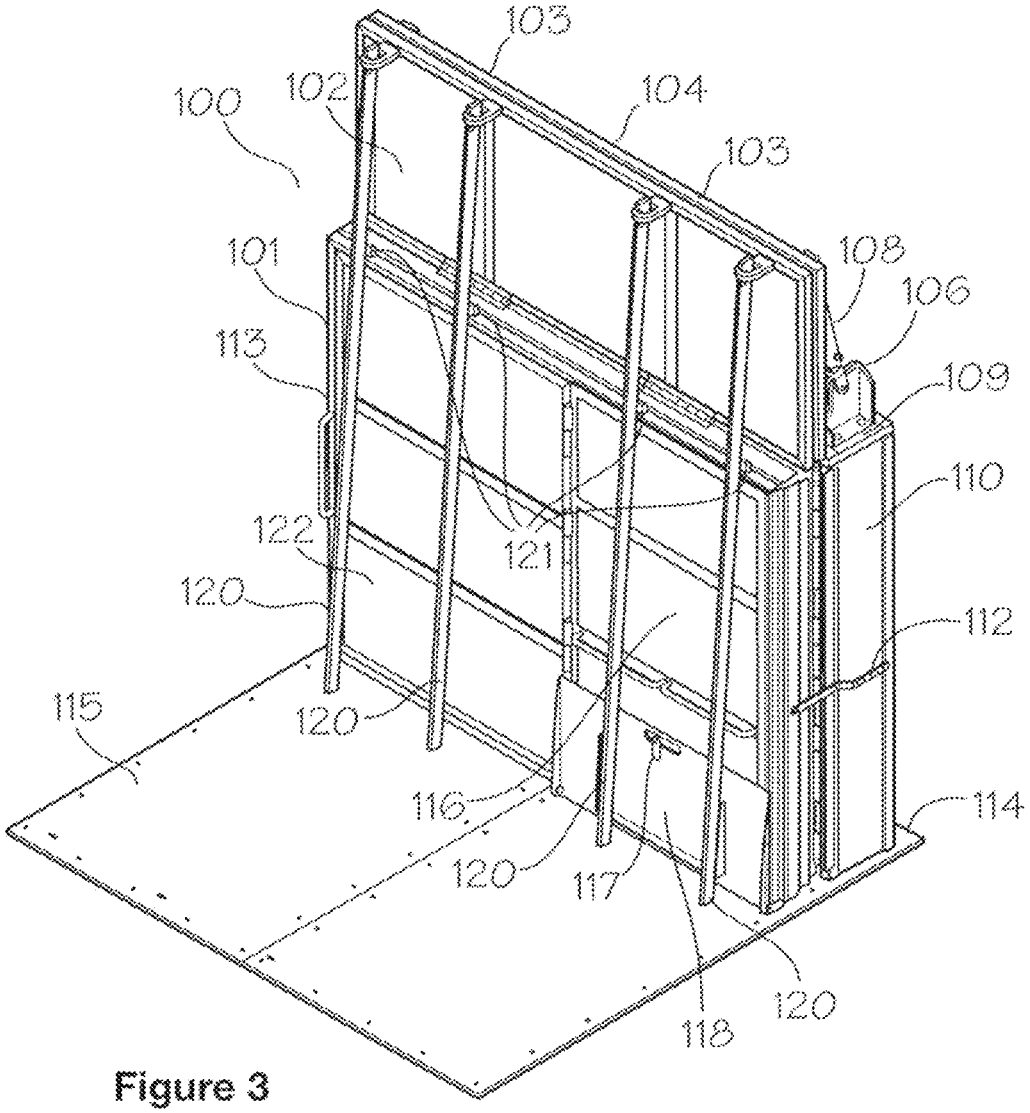
FIG. 3 shows a shelter of the current disclosure in a closed configuration.

FIG. 3 shows a shelter 100 of the current disclosure in a closed configuration 101. In closed configuration 101, shelter 100 may be stored against a wall or alcove in a room, for purposes of example only and not intended to be limiting, a class room. Shelter 100 may in include a top panel front section 102 and a top panel back section 104. Panels 102 and 104 may be constructed from materials including but not limited to composite ballistic material, carbon fiber, Kevlar, metal plates (steel, aluminum, boron, titanium, blended metal, centered metal), alloys, concrete, man-made synthetic fibers and epoxy, Ultra-high-molecular-weight polyethylene, Monolithic based hard armor panels, and/or ceramics. In one embodiment, all panels of shelter 100 may be formed from composite ballistic materials as known to those of skill in the art. Shelter 100 may expand from closed configuration 101 via the weight of top panels 104 and 102, which may weigh multiple hundreds of pounds, propelling front panel 122 outward from bookcase 110. Given the amount of weight perched atop shelter 100, dampener 108, such as a hydraulic dampener, tie rod, or welded cylinders, may serve as an extension damper to prevent top panels 104 and 102 from slamming down into place when shelter 100 opens by dampener 108 exerting rearward pressure on top panel 104 to slow its descent from atop unit 100. Other means of extending open unit 100 include hydraulic methods, air compression electrical/mechanical methods, worm screws, mechanical levers, solenoid, leaf or coil springs, counterweights, etc., as known to those of skill in the art. Dampener 108 may be affixed to a dampener bracket 106 to provide leverage for dampener 108 to slow opening of shelter 100 by slowing the extension of front panel 122 (and first side panels 125 and second side panels 126, see FIG. 4) away from bookcase 110 in a controlled manner via the restraining force of dampener 108 pulling upon top panel back section 104.

Top panel back section 104 is hinged to top panel front section 102 via top hinges 103, and pushes top panel front section 102 away from bookcase 110. Lift bars 120 may serve to guide shelter 100 into its extended configuration 123 (see FIG. 4) as well may influences front panel 122 forward via lift bars 120 acting upon frame attachments 121 to propel front panel 122. Front panel 122 may be formed from steel and composite ballistic material. Lift bars 120 are used to close or collapse shelter 100 from extended configuration 123 (see FIG. 4) via fulcrum lift attachments 121 that serve as fulcrums for lift bars 120. Lift bars 120 may serve as levers to help lift the top panel sections 102 and 104 into the closed configuration as well as propel front panel 122 from the open position to the closed position. In one embodiment, lift bars 120 do not extend to floor plate 114. Floor plate 114 may be attached to bookcase 110 and allows front panel 122 to glide across its upper surface 115. Floor plate 114 may also be affixed to the floor of the room by screws and anchors before the bookcase is installed. When installing the bookcase, anchors may pass through the inside upper surface of the bookcase through the floor plate 114 into the subfloor area for anchoring. Floor plate 114 may be formed from stainless steel, which will not rust and will provide a smooth surfacing for opening shelter 100 as well as shows the size of the extended configuration 123, even when shelter 100 is in closed configuration 101. Front panel 122 may include a door assembly 116 for entering the interior of shelter 100 as well as an access ramp 118, secured by ramp latch 117, to ease the transition from the room floor into shelter 100, as well as to accommodate wheel chairs or persons with limited mobility. The direction of the swing of door assembly 116 should be as required by the applicable building code for the normal occupancy of the space and the egress door(s) should be operable from the inside without the use of keys or special knowledge or effort, door assembly 116 may be configured to only swing outward as an exit door to meet National Building Code Standards.

Activation of dampener 108 may be affected by simply unlatching latch 112 (an opposing latch, not shown, may be positioned on opposing side 113), a slight continuous tug on front panel 122 may provide torque to start to overcome the coefficient of friction to move top panels 102 and 104 away from bookcase 110 until the top panels 102 and 104 "topple" forward based on gravity, once passing the balance point of the combined weight. Unlatching latch 112 allows the weight of top panels 102 and 104, offset by dampener 108 as explained supra, to propel forward front plate 122 via the top panels acting on forward plate 122. Multiple dampeners 108 may be affixed to top 109 of shelter 100 to increase the force used to restrain opening shelter 100.

Figure 4:
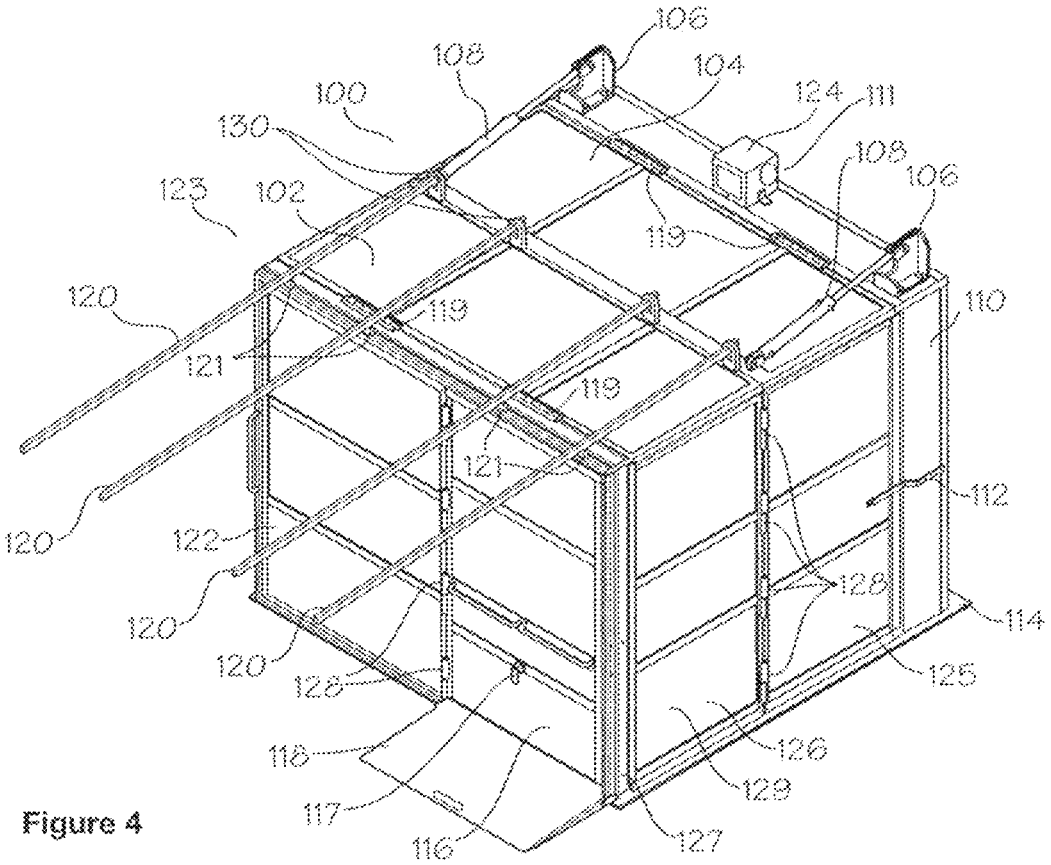
FIG. 4 shows a shelter of the current disclosure in an expanded or open configuration.

FIG. 4 shows a shelter 100 of the current disclosure in an expanded or open configuration 123. In open configuration 123 shelter 100 is fully extended from bookcase 110. First side panel 125 and second side panel 126 (with opposing first side panel 125 and second side panel 126, not shown, positioned on opposing side 113 of shelter 100) are now extended. First and second side panels 125 and 126 made be made from composite ballistic material, carbon fiber, Kevlar, metal plates (steel, aluminum, boron, titanium, blended metal, centered metal), concrete, alloys, man-made synthetic fibers and epoxy, Ultra-high-molecular-weight polyethylene, Monolithic based hard armor panels, ceramics, etc. While only two panels are shown on first side 129, first side 129 and opposing side 113 may be formed from more or less panels, such as 1, 3, 4, 5, etc., and the current disclosure should not be read as limited to the sides being formed from only two side panels. First and second panels 125 and 126 may be secured to one another via hinges or other means known to those of skill in the art. Side panels 125 and 126 may also be hinged to front frame 127 and bookcase 110 in order to allow the doors to fold inward when shelter 100 is collapsing into closed configuration 101. In one embodiment, given the respective weight of the panels, vault or vertical hinges may be employed wherein a female hinge pin sits atop a male hinge pin.

In extended configuration 123, shelter 100 forms an impervious structure that may safeguard multiple individuals, such as a school classroom of children, who may access shelter 100 via ramp 118 and door assembly 116. Door assembly 116, may be hinged to front panel 122 to allow the door to swing open and closed. In the extended configuration 123, top panel back section 104 and top panel front section 102 are now fully extended via movement upon panel hinges 119. As part of its security suite, shelter 100 may include a speaker 124 to allow the occupants to communicate outside shelter 100. Further, a camera 111 may be incorporated to allow the occupants of shelter 100 to view external situations while inside shelter 100.

Figure 5:
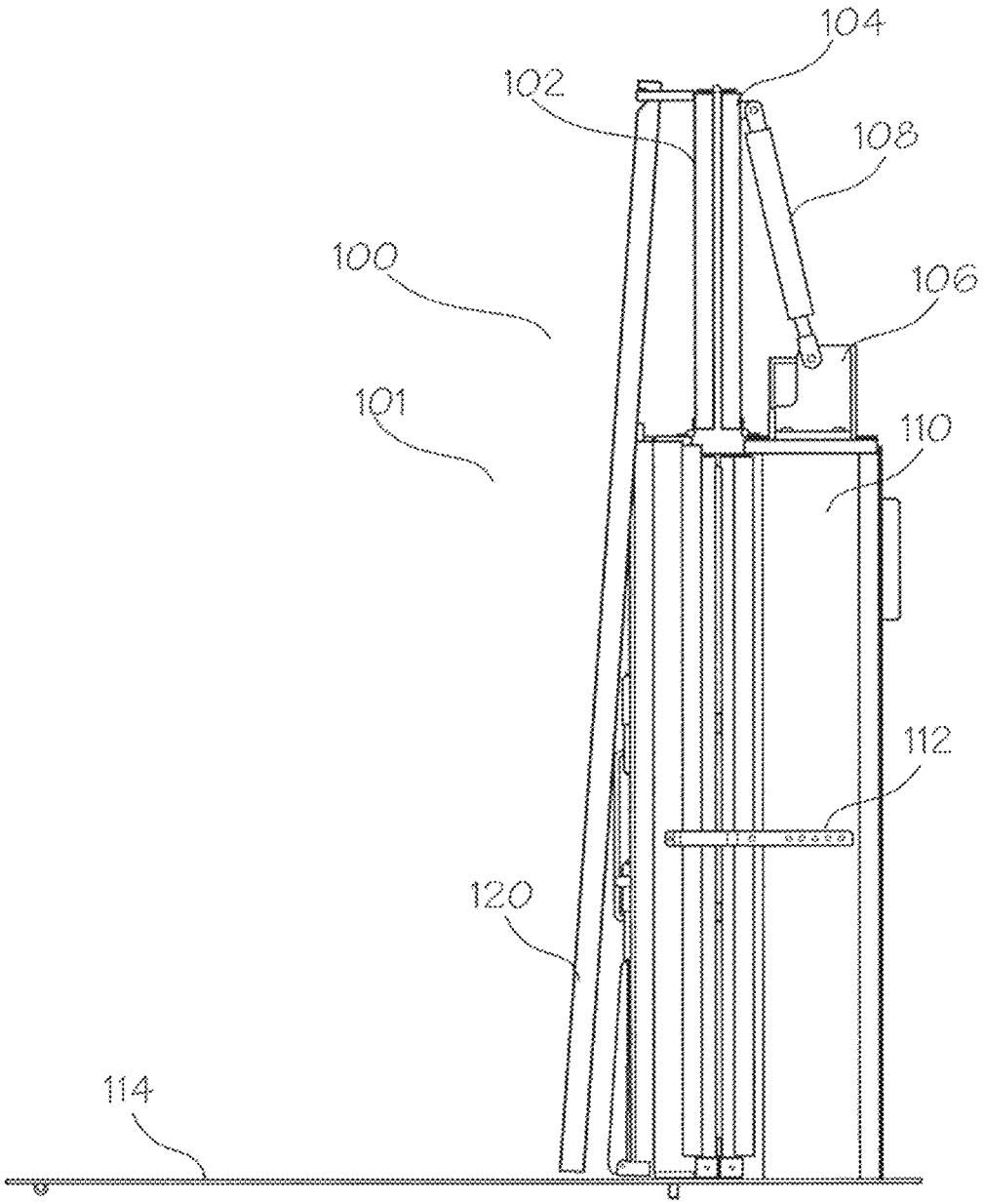
FIG. 5 shows a side profile of a shelter of the current disclosure in a closed configuration.
Figure 6:
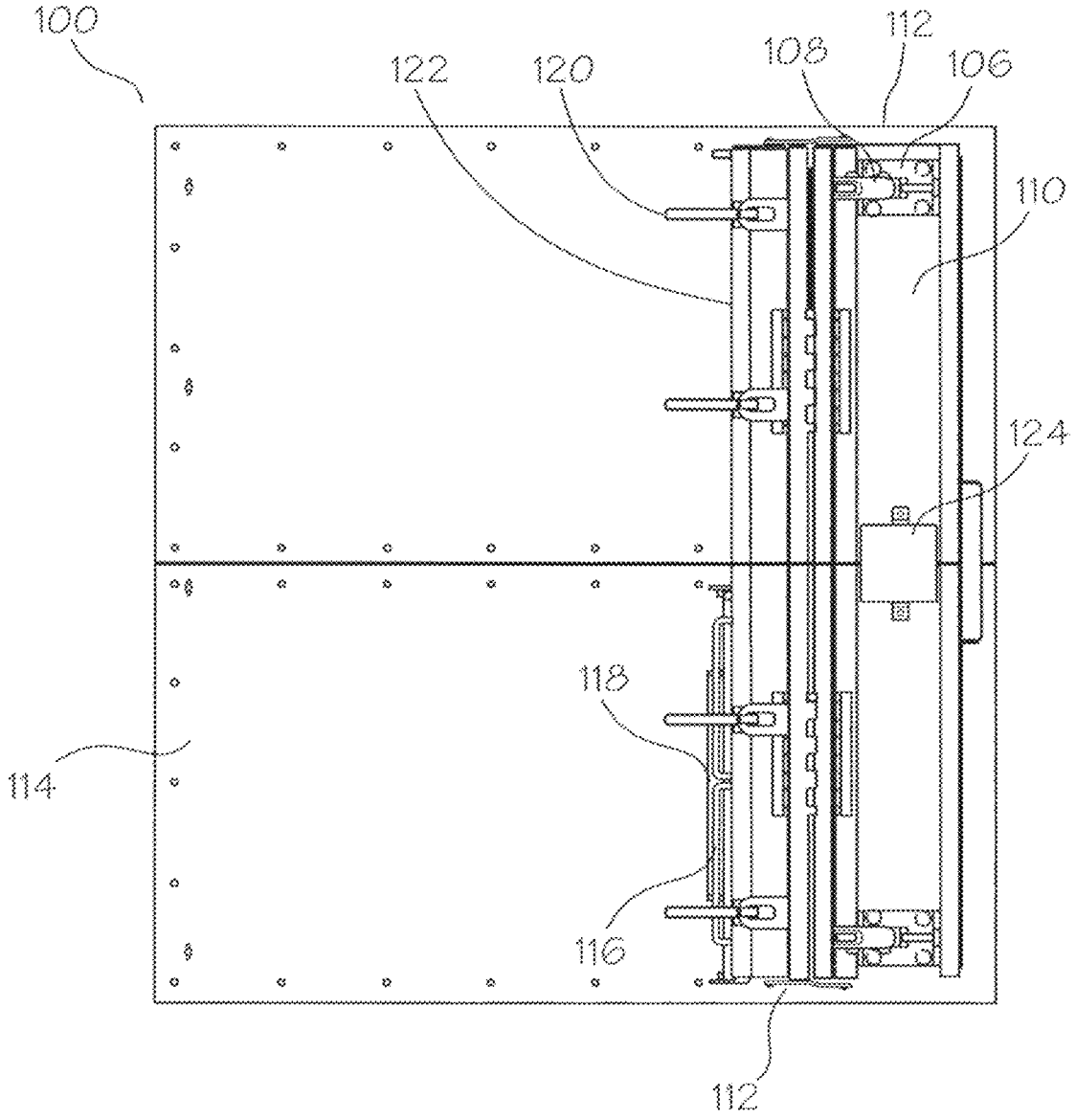
FIG. 6 shows a top down view of a shelter of the current disclosure in a closed configuration.

FIG. 5 shows a side profile 130 of shelter 100 in closed configuration 101. FIG. 6 shows a top down view of shelter 100 in a closed configuration 101.

Figure 7:
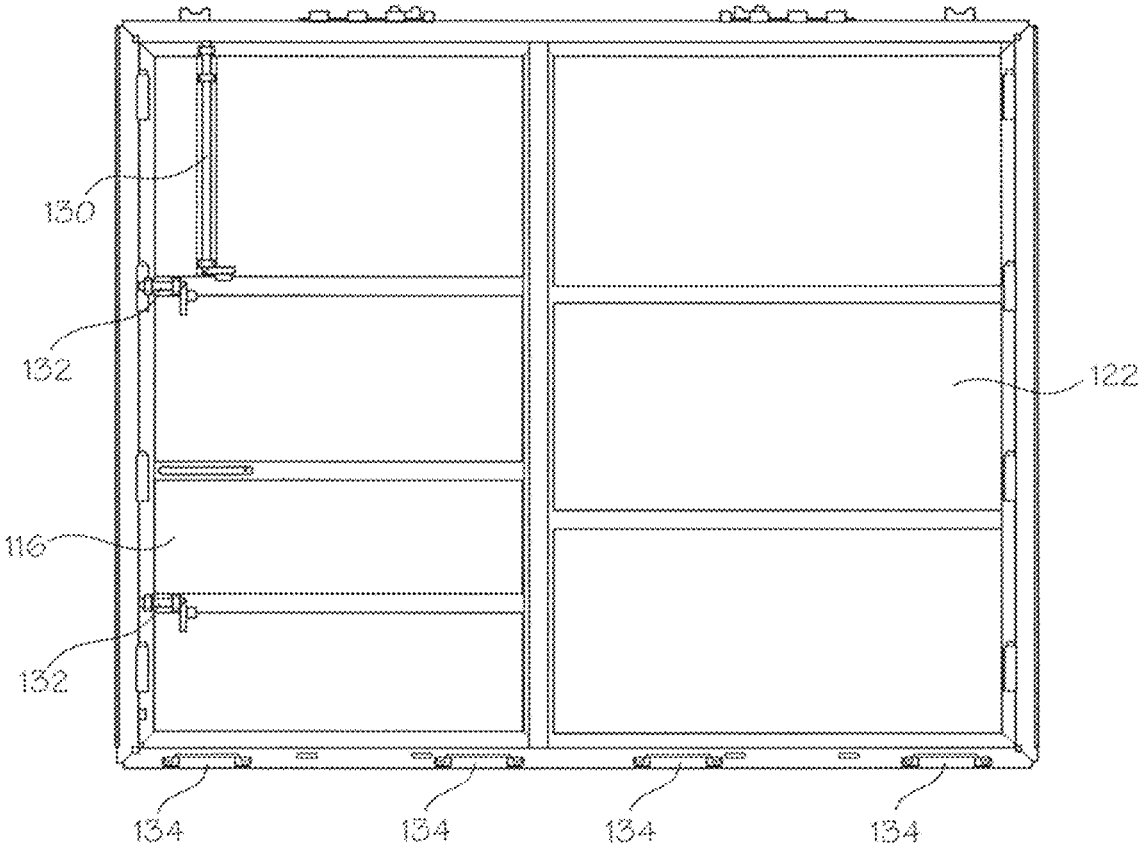
FIG. 7 shows one embodiment of an interior of a door assembly and front panel of the current disclosure.

FIG. 7 shows the interior of door assembly 116 and front panel 122 including vertical latch 130 and horizontal latches 132 and roller supports 134. While only one vertical latch 130 and two horizontal latches 132 are shown, more or less latches are considered within the scope of this disclosure. These latches may be located within shelter 100 pursuant IAW ADA height requirements so they are operable for persons in a wheelchair.

Figure 8A:
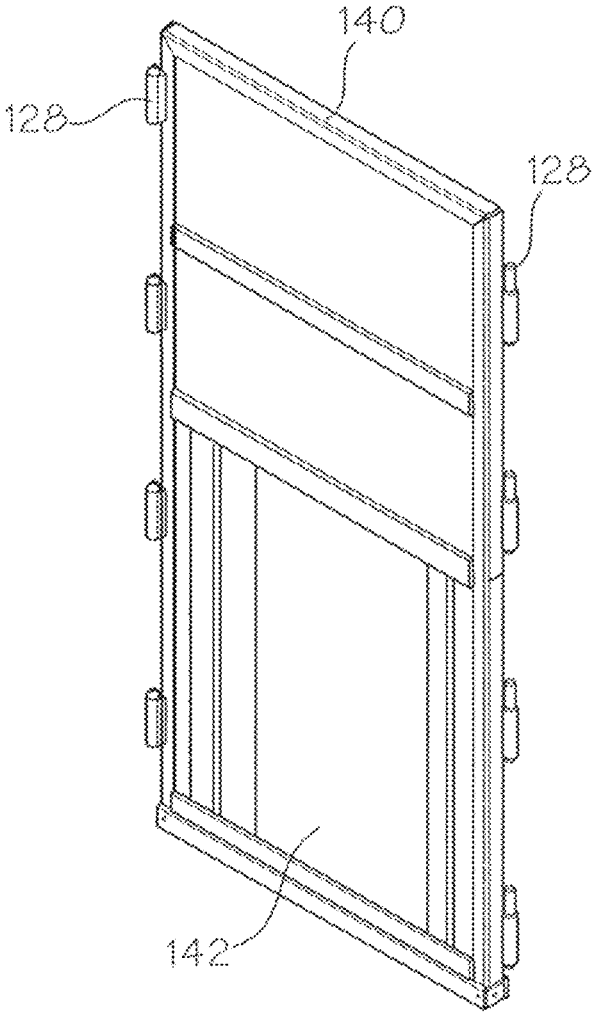
FIGS. 8A and 8B show an exterior view (8A) and interior view (8B) of a modified side panel of the current disclosure that includes an egress door and a locking mechanism.
Figure 8B:
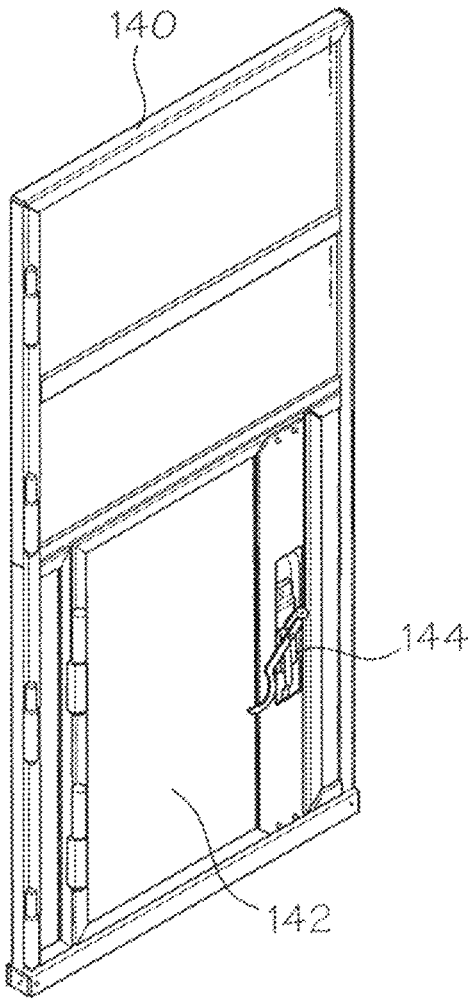

FIGS. 8A and 8B show an exterior view (8A) and interior view (8B) of a modified side panel 140 that includes egress door 142 and a locking mechanism 144 on the interior of modified side panel 140 to secure egress door 142. An egress door 142 may be added in addition to door assembly 116 and positioned on a side panel of shelter 100. In this way, an additional means of exiting shelter 100 is provided and may be positioned such that it is not visible while looking at door assembly 116, such as placing egress door 142 on first side panel 125 or second side panel 126 on opposing side 113 of shelter 100. In one embodiment, egress door 142 may be placed on the second side panel opposite door assembly 116. Egress door 142 may either open outward or inward based on local codes and/or the owner's preference.

Figure 9:
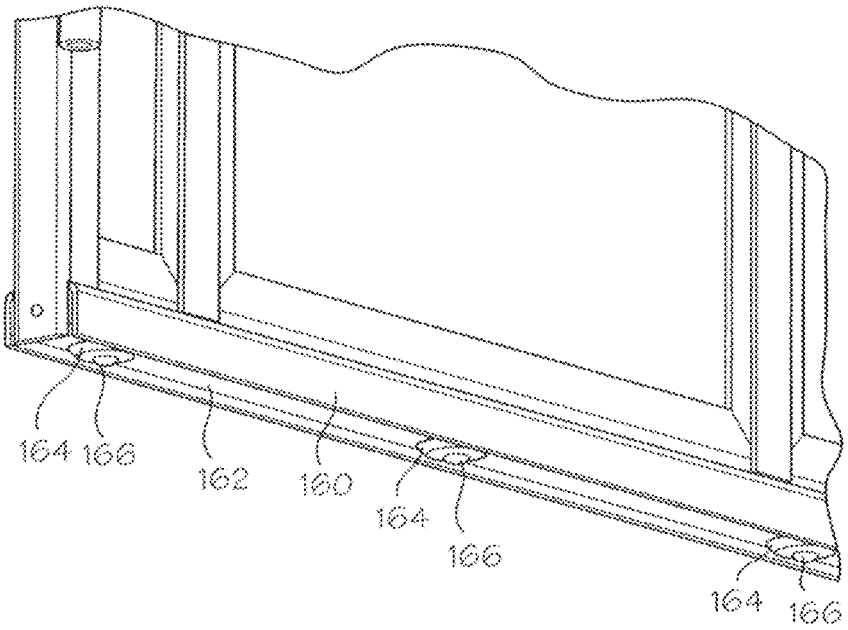
FIG. 9 illustrates a transfer ball assembly that may be positioned on the bottom of side panels on a shelter of the current disclosure.

FIG. 9 illustrates a transfer ball assembly 160 that in one embodiment may be positioned on the bottom 162 of side panels 125 and 126 in order to allow panels 125 and 126 to roll or "glide" open when configuring shelter 100 in the extended configuration 123 or returning same to closed configuration 101. This movement may be accomplished in one embodiment via use of bearing assemblies 164 that contain balls or bearings 166 that roll to allow the panels to move into and out of position on floor plate 114 in order to speed deployment time of shelter 100. Ball assembly 160 may be positioned on the bottom of side panels 125 and 126 and may travel/move omni-directionally, as opposing to uni-directionally, for improved deployment of shelter 100. Further, when shelter 100 is opening or closing, transfer ball assemblies may move in an arcuate manner pattern atop floor plate 114, carrying most of the weight of side panels 125 and 126. In a further embodiment, ball assembly 160 may be replaced with disk rollers. The disk rollers may comprise multiple thin ball bearing wheels that are placed on an axle with a washer separating each wheel. In a further embodiment, the disk rollers are located on the front bottom corner of both left and right rear side panels. As the shelter opens or closed, these panels take a 90 degree arc and each ball bearing wheel will rotate and track at its own speed, separate from the other wheels.

Figure 10:
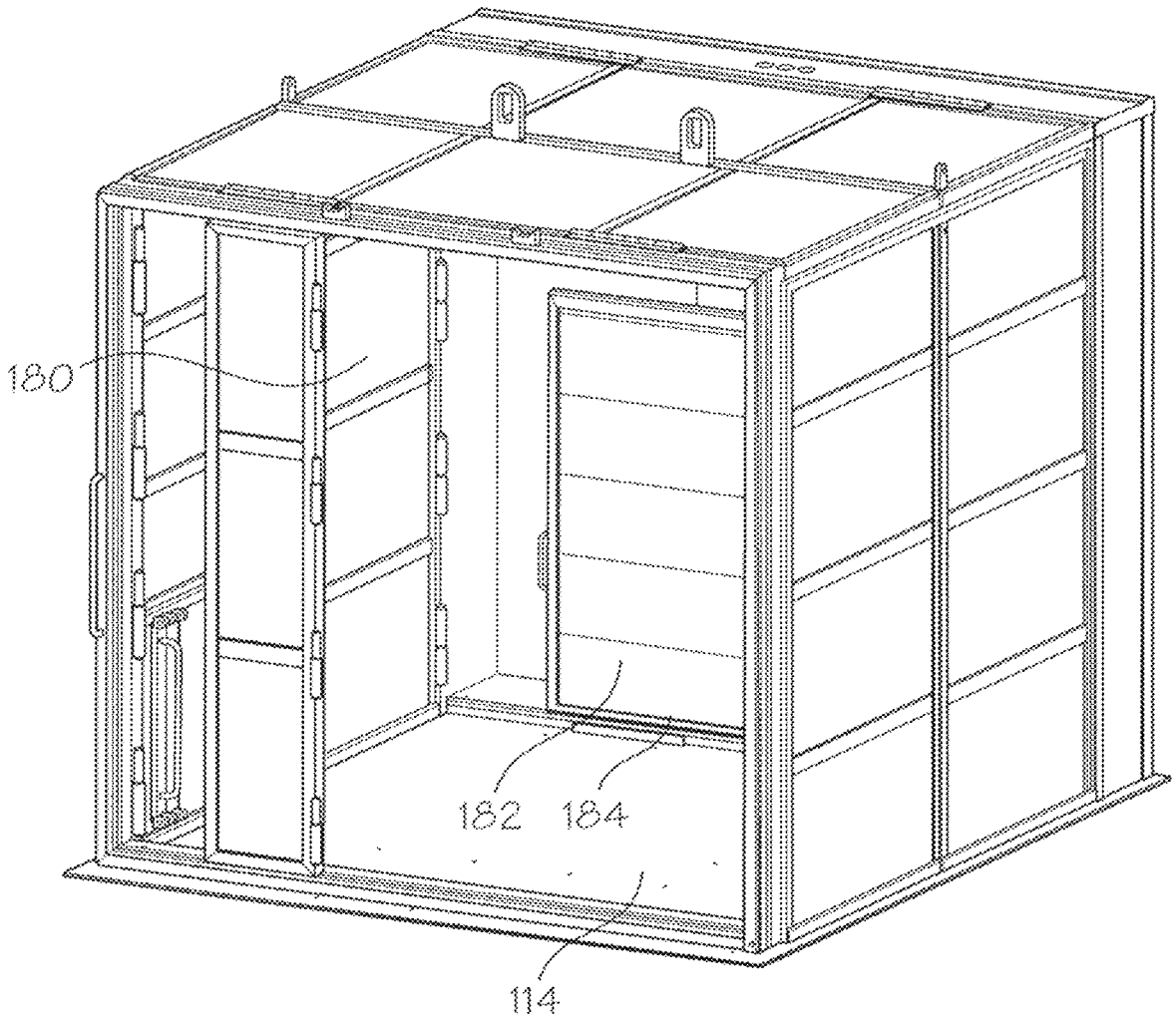
FIG. 10 shows a partially disassembled view of one embodiment of a shelter of the current disclosure with the front panel and door assembly removed to show the interior of the shelter.

FIG. 10 shows a partially disassembled view of shelter 100 with front panel 122 and door assembly 116 removed to show the interior 180 of shelter 100. In this configuration, floor panel 182 is in an upright position 184 and has not yet been laid down upon floor plate 114. Floor panel 182 may be one piece or multiple pieces and may be hinged in order to fold up and down within shelter 100. In one embodiment, floor panel 182 may be comprised of a cushioned material to provide comfort and sound dampening effects for those within shelter 100. Floor panel 122 may be made from wood, plastic, steel, aluminum, engineering foam and combinations thereof, as known to those of skill in the art. In one embodiment, floor panel 122 when deployed in lowered position 190, see FIG. 11, keeps side panels 125 and 126 "locked" in position.

Figure 11:
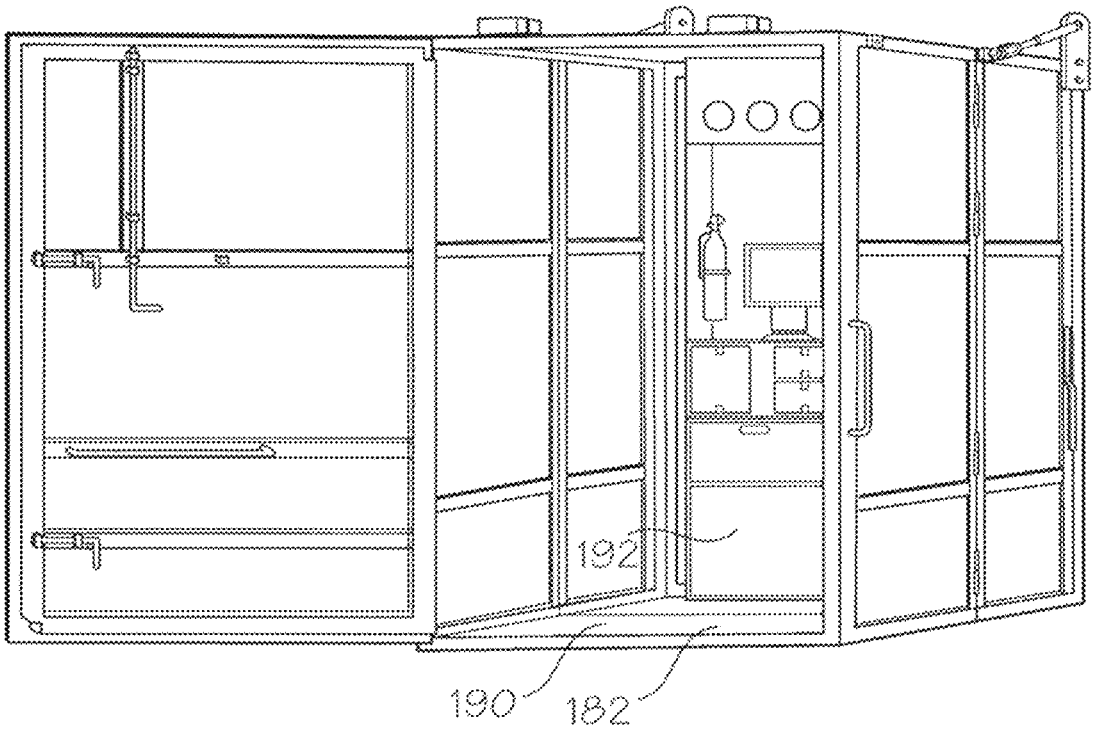
FIG. 11 shows one embodiment of a shelter of the current disclosure in an extended configuration with a floor panel in a lowered position.

FIG. 11 shows shelter 100 in extended configuration 123 with floor panel 182 in lowered position 190. Further, shelter 100 may include a supply center 192 that may contain first aid, weapons, survival supplies, water, radios, ear plugs, dust masks, bullet stops for ventilation access ports, etc.

Figure 12:
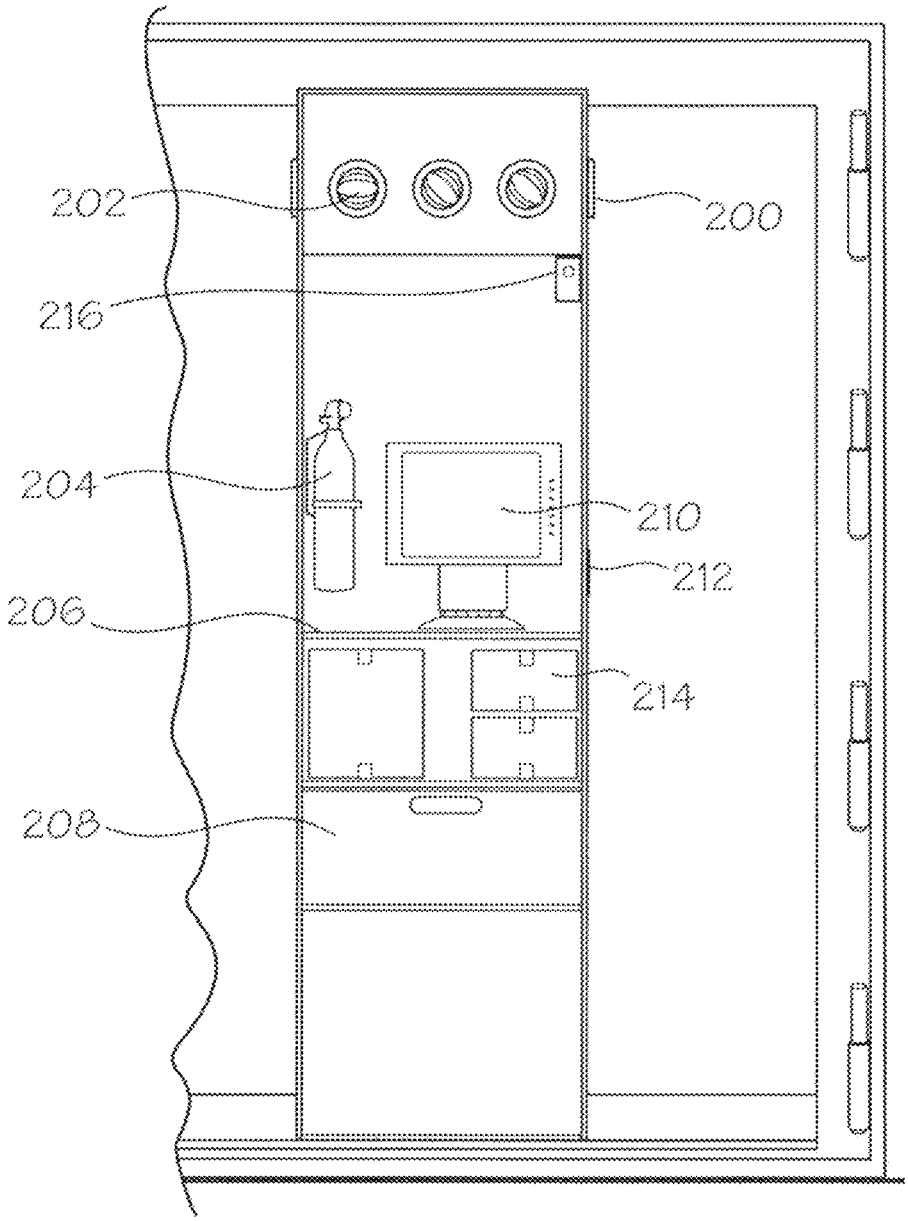
FIG. 12 illustrates one embodiment of a supply cabinet that may be contained in a shelter of the current disclosure.

FIG. 12 shows a cabinet 200 that may be included in shelter 100. Cabinet 200 may include an intake fan 202, and accompanying wiring for same, not shown, a fire extinguisher 204, a shelf 206 for storing materials, a drawer 208, an informational display 210, which may control the on-board electronics of shelter 100. In one embodiment, information display 210 may communicate via wi-fi, or other means known in the art, to deliver timed diagnostic reports while shelter 100 is in closed configuration 101, an electrical outlet 212, and supplies 214. A camera 216 may be included in order to allow maintenance checks on the fill level of extinguisher 204 while shelter 100 is in closed condition 101. Camera 216 may be stationary and angled for the best view of the interior or it may be a movable camera capable of panning along the interior.

In a further embodiment, multiple shelters 100 may be combined by removing the respective side panels forming the "common wall" between the two shelters 100 in order to for a larger unit, with more interior space and higher occupancy, to be formed.

Figure 13:
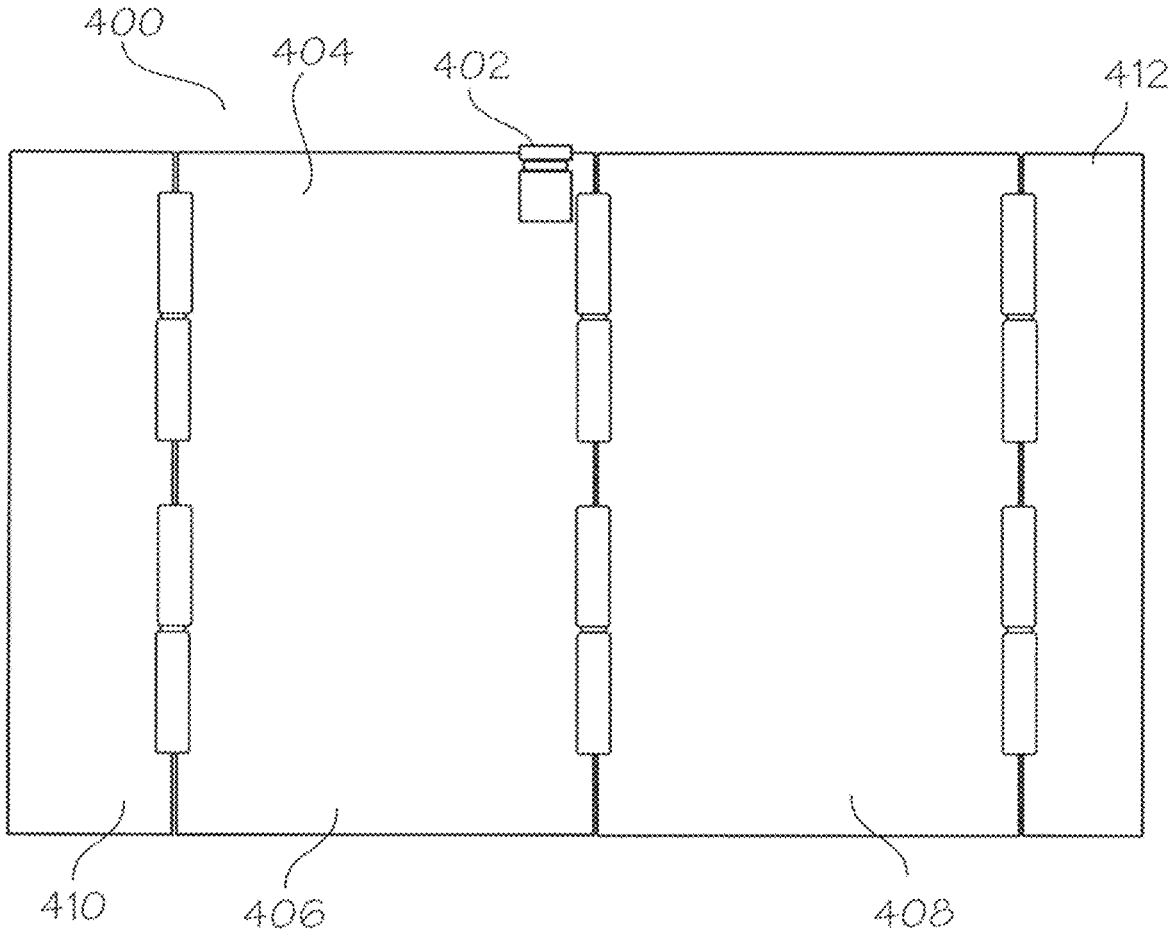
FIG. 13 shows an alternative embodiment side view of a shelter of the current disclosure.

FIG. 13 shows an alternative embodiment side view of a shelter 400. In this embodiment, a slam reduction damper 402 may be placed on a side 404 of the shelter in order to reduce the noise associated with deploying shelter 400 as well as the shock loading during deployment. In one embodiment, the slam reduction damper 402 may be placed on rear side panel 406 before front side panel 408 in order to aid in reducing the "slam" noise and force that occurs when one activates shelter 400 and it expands outward from bookcase 410 in order to extend anti-ballistic barrier 412 forward and into place. Potential dampers suitable for slam reduction damper 402 include rubber dampers, dashpot and spring dampers using pneumatic and/or hydraulic systems. In a preferred embodiment, a hydraulic damper may be used. In use, damper 402 reduces the impact of the roof panels, not shown, striking the rear side panels 406 and front side panels 408. In one further embodiment, damper 402 provides a resistive load during the entire extension of shelter 400. In a further embodiment, damper 402 provides a load during substantially most of the extension but serves as a slam protection device at the end of the stroke.

Figure 14:
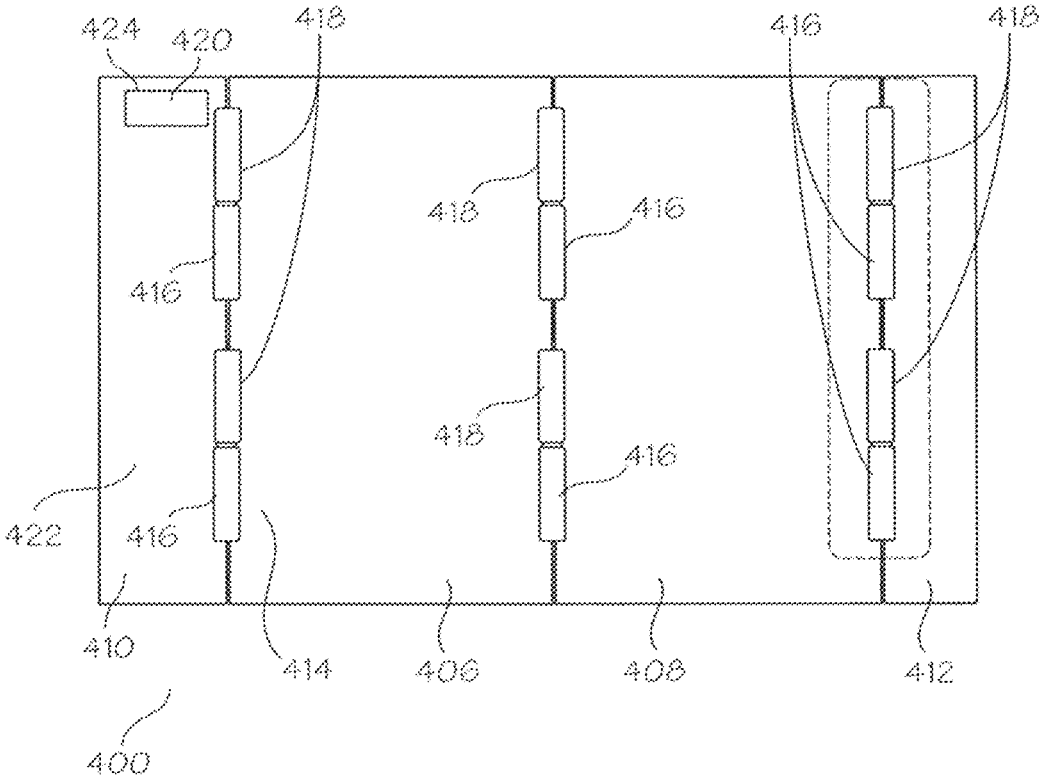
FIG. 14 shows one possible hinge configuration for shelters of the current disclosure.

FIG. 14 shows one possible hinge configuration 414 for connecting bookcase 410 to rear side panel 406, front side panel 408, and antiballistic barrier 412. In this configuration, at least one set of pin hinges 416 are mounted to bookshelf 410 and at least one set of receiver (hole) hinges 418 are mounted to rear side panel 406. Rear side panel 406 may then be connected to front side panel 408 via, at least one, a pin hinge 416 welded to rear side panel 406 and, at least one, a receiver hinge 418. Front side panel 408 is then connected to antiballistic barrier 412 via, at least one, pin hinge 416 welded to antiballistic barrier 412 and, at least one, receiver hinge 418 welded to front side panel 408. This configuration provides that side panels 406 and 408 do not support any weight of the antiballistic barrier 412, as well as the roof panel (not shown), and enables front side panel 408 to act as a floating panel, which will minimize the load through the front side panel 408 and antiballistic barrier 412.

In a further embodiment, in order to reduce the opening force of shelter 400, springs, such as torsional springs or compression spring plungers may be used. As shown by FIG. 14, a spring 420 may be mounted on bookcase 410 in order to provide additional force for opening shelter 400 that to does not have to be supplied by the user. Spring 420 may be mounted on both sides of bookcase 410 positioned along the height 422 of bookcase 410. In a preferred embodiment, spring 420 may be located below the halfway point of height 422 in order to help the rollers overcome the coefficient of friction. If spring 420 is placed too high, the rollers will remain stationary, similar to towing a vehicle by attaching at a low point and not to the roof of the vehicle. In a preferred embodiment, spring 420 is placed near the top of bookcase 410. When closed, spring 420 is compressed, at opening, spring 420 extends and acts on antiballistic barrier 412 to force the barrier forward and aid in opening shelter 400. In alternative embodiments, spring 420 may be placed within shelter 400 in order to prevent access or tampering with the spring. In still further embodiments, spring 420 may be enclosed in a sheath 424 to prevent access to spring 420. Further, at full compression, the spring should exert less than the maximum pulling load to open shelter 400. In a further embodiment, a plunger rod may be associated with spring 420.

Figure 15:
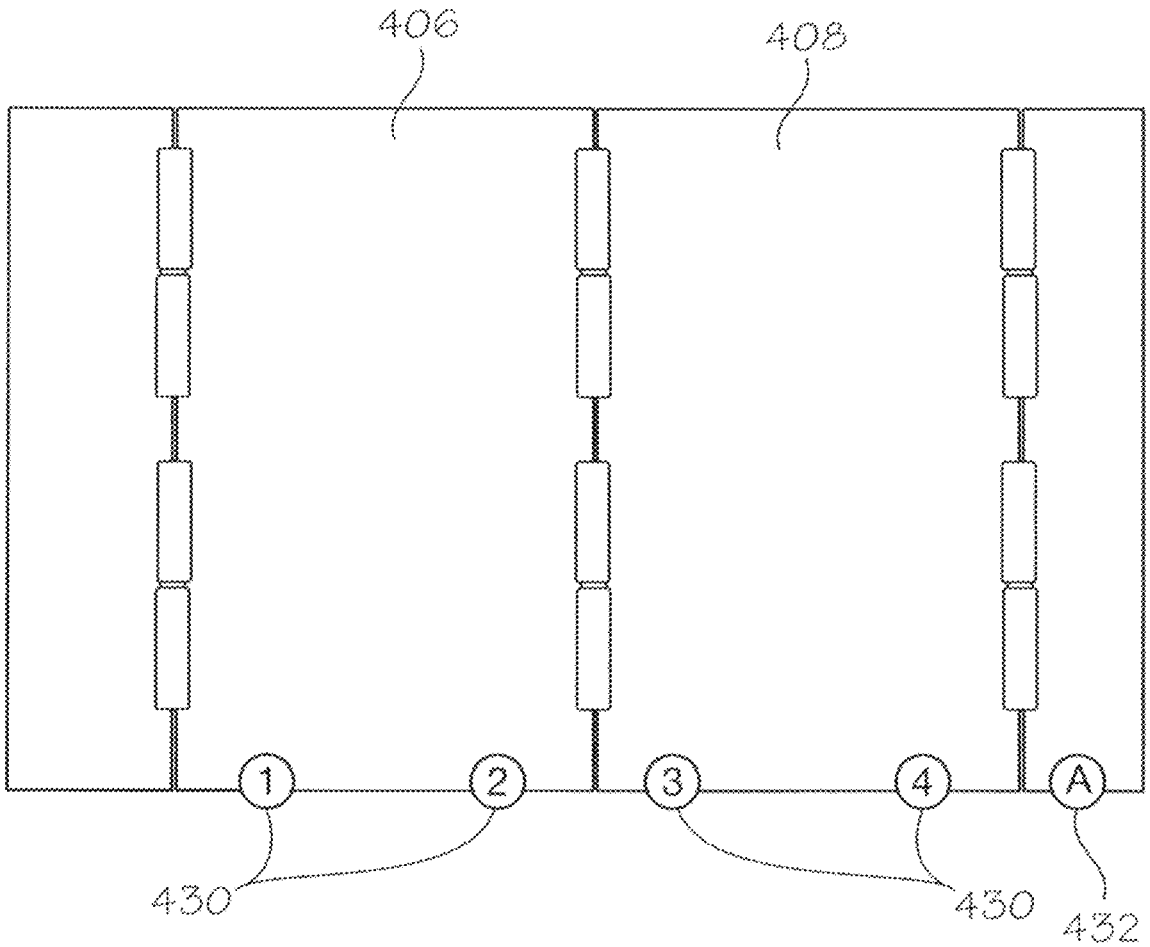
FIG. 15 shows one embodiment of how rollers may be used to help extend and contract a shelter of the current disclosure.

FIG. 15 shows one embodiment of how rollers may be used to help extend and contract shelter 400. As FIG. 15 shows, omni-directional rollers 430, such as the Keitek K0140, may be used to assist rear side panel 406 and front side panel 408 to move between collapsed and extended configurations. In addition, antiballistic barrier 412 may be fitted with a cylindrical roller 432. In a further embodiment, omni-directional rollers 430 may be replaced with other rollers, such as cylindrical roller 432. In a further embodiment, omni-directional, or other, rollers 430 positioned on rear side panel 406 may be affixed substantially below slam reduction damper 402. While four omni-directional rollers 430 are shown, more or less rollers are considered feasible for this construct.

Figure 16:
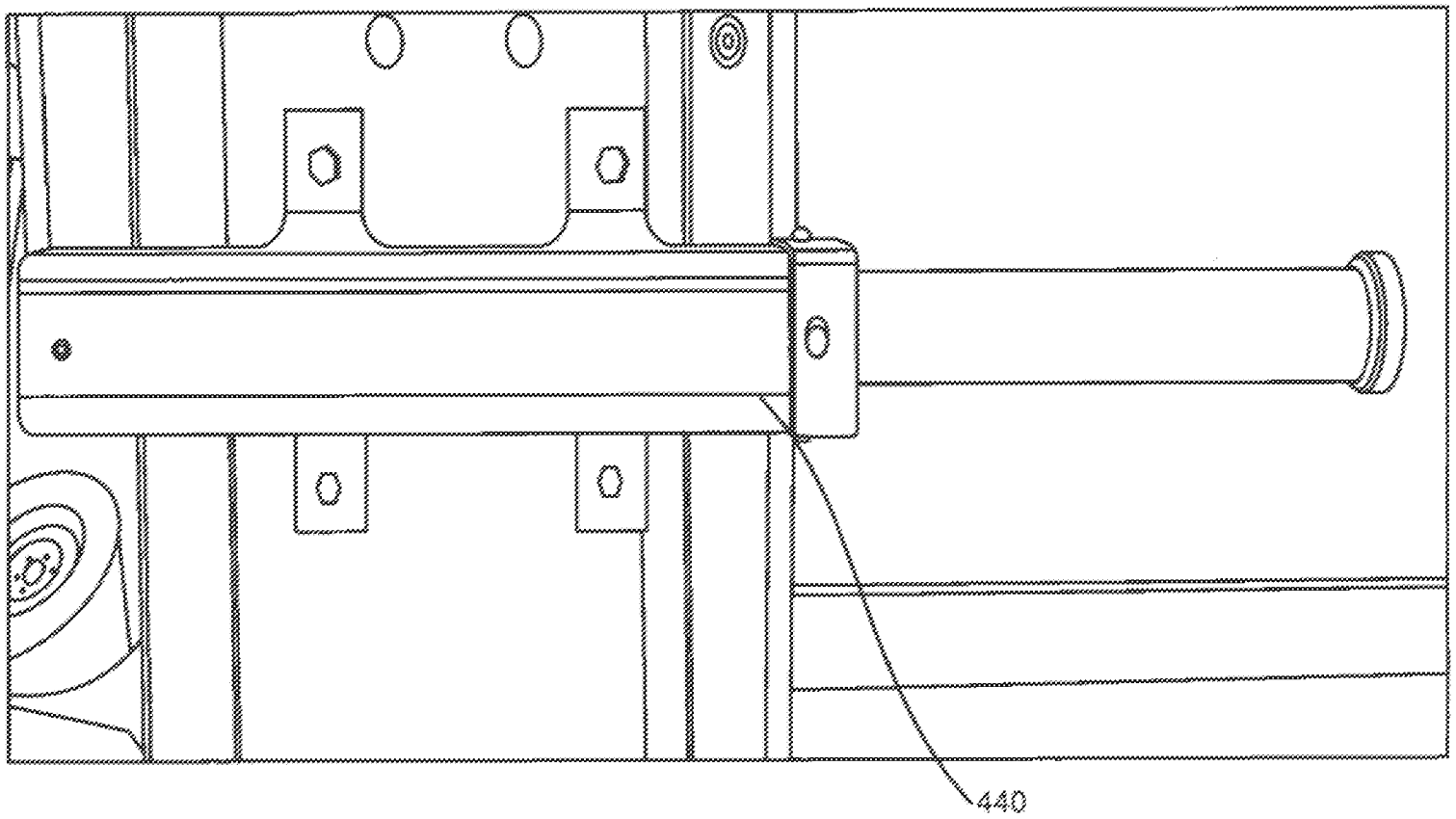
FIG. 16 shows a photograph of an external view of a spring assist device of the current disclosure.
Figure 17:
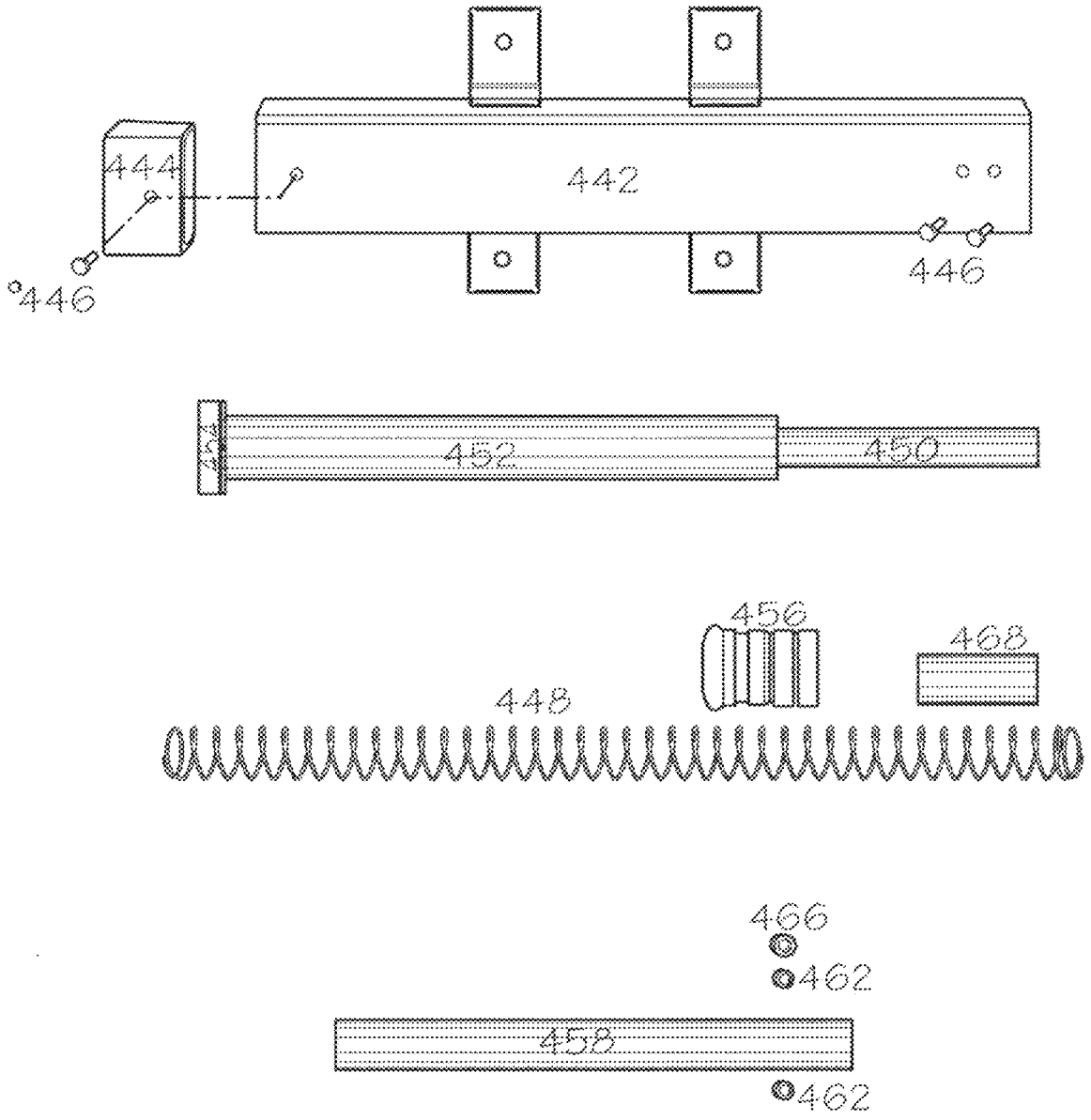
FIG. 17 shows and exploded view of spring assist device of the current disclosure.

FIG. 16 shows a photograph of an external view of a spring assist device 440 of the current disclosure. Spring assist device 440 will help provide the initial pulling force needed to open the shelter. FIG. 17 shows and exploded view of spring assist device 440. This may include a spring assist housing 442, which has a front cap 444 at the proximal end of spring assist housing 442, affixed via front cap spanner screws 446. Spring 448 resides on spring guide rod 450, which is contained in spring guide tube 452. Spring guide tube 452 has a rubber push pad 454, which serves as the proximal end of spring assist device 440 and ensures spring assist device 440 does not mar or damage the surface against which sprint assist device 440 applies force via spring 448 extending. Stop coupler 456 is affixed around the distal end of spring guide tube 452 and prevents spring guide tube 452 from completely protruding from spring assist housing 442. Spring guide rod inner housing 458 is affixed within spring assist housing 440 via a guide rod anchor bolt 460 extending through guide rod inner housing 458 as well as opposing walls of spring assist housing 442 via spacers 462 and nut 464. Spring guide rod inner housing 458 allows spring 448 to rest on guide rod anchor bolt 460 and assists with compressing spring 448 when force is applied to spring guide tube 452. Front tube spacer 468 determines the amount of strength placed on the spring, front tube spacer 468 fits over spring guide rod 450 and inside spring guide tube 452. One may make spring 448 stiffer, higher PSI resistance, by making front tube spacer 468 longer or make spring 448 less resistant by shortening front tube spacer 468.

Figure 18:
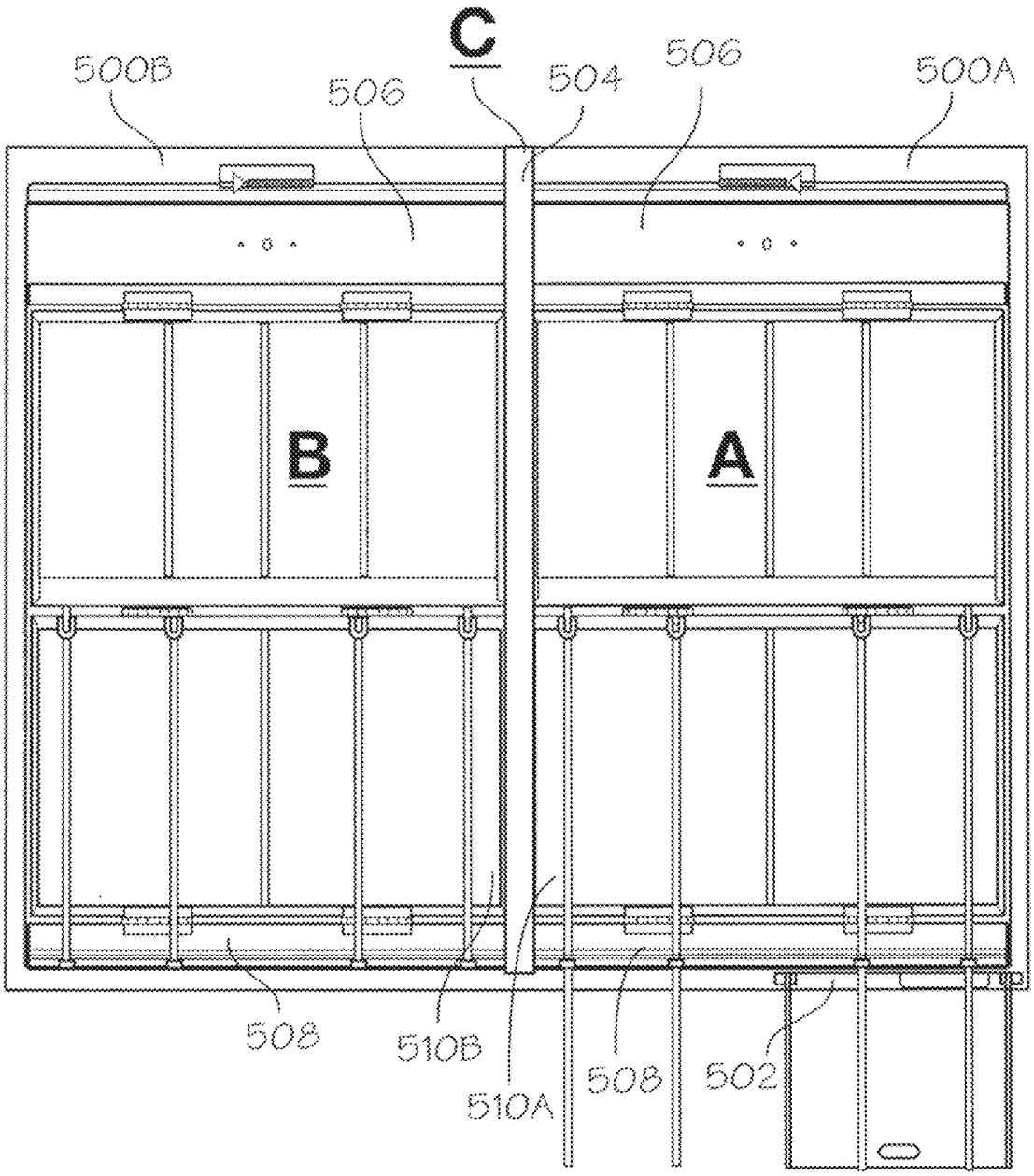
FIG. 18 shows a top down view of a conjoined system using two shelters of the current disclosure.

In addition, the current disclosure also provides for size-scalability of a shelter of the current disclosure. For instance, FIG. 18 shows a top down view of a conjoined system where two shelters 500A and 500B are joined via removing the ballistic material on the left side of shelter 500A and the ballistic material at the left side of shelter 500B. While either or both shelters may have a door, in this embodiment, shelter 500A has a door 502. A connector 504, shown by line C-C, such as a 2-4" plate, beam, or other structure, may conjoin the two units so that they open simultaneously when activated. In other embodiments, multiple connectors 504 may be employed, such as joining together bookcases 506 or antiballistic barriers 508 via bolting or other means as known to those of skill in the art. In a further embodiment, roof plate 510A may extend over line C-C to cover a portion of roof plate 510B. Connector 504 maintains the current hinge design and ensures simultaneous opening of multiple shelters 500 do not bind/conflict/hit one another during opening.

Figure 19:
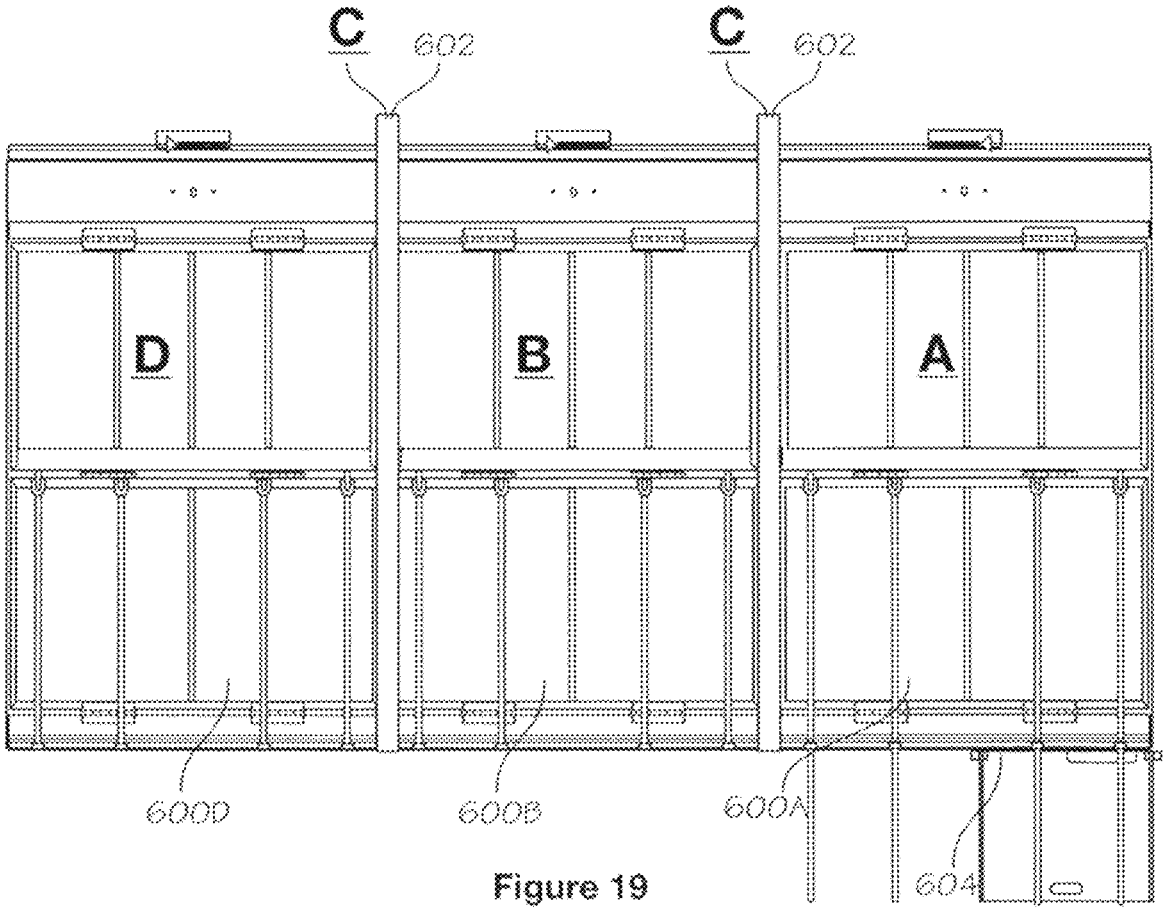
FIG. 19 shows a further embodiment of the current disclosure where three shelters of the current disclosure are joined together.

FIG. 19 shows a further embodiment of the current disclosure where three shelters, 600A, 600B, and 600D are joined by connectors 602. In this embodiment, shelter 600A has a door 604, however, all three or just two of the shelters may have doors as well. In this 3-piece construct, ballistic materials on the left side of shelter 600A has been removed, the left and right side ballistic material has been removed from shelter 600B, and the right side ballistic material is removed from shelter 600D. Passageways may be constructed throughout the structure via modification of the front side panels, both on 600B, the left front side panel on 600A and the right front side panel on 600D. Connectors 602 will connect the three shelters at their common joints as shown by line C-C. The roof panels of shelters 600D and 600A will overlap onto the roof panels of shelter 500B and cover the joined areas shown by lines C-C.

In one embodiment, to use the shelter and open it: the first step is to unlatch the shelter on the left and right side or from a central latch in the center front of the shelter. The second step is to pull on the pull handle and gain assistance from the spring assists, the shelter then starts to move/roll straight forward. After about 10 inches of spring assist, the roof panels start to push the shelter forward with their weight assisted by gravity. At this time, any electronics within the unit could be made to automatically boot up and to turn on lights and fans so the entry is not a dark unlit place. Next, the shelter will fully open, roof panels slam down and the floor slams into place, locking the sides, front and roof panels into place. The next step is to remove the door retaining pin, let it drop and open the door wide enough for quick entry. At this time, the door may be used as a shield by the person in charge. Once everyone has entered, the door is pulled shut, and the door bolt is slid into place. The other door bolts are also slid into place for added protection.

After use, one may close the VAST6. The first step is to lift the floor upright toward the bookcase and latch the floor into the floor latch retaining mechanism. Second step is to close the door with the door retaining pin. Third step is to place the lift bars into position where the notched end of each lift bar fits into the lift bar lift points and the edge of the lift bars are resting of the lift bar fulcrums on the front edge of the front panel. The next step is downward pressure is placed on each lift bar, sufficient to lift the roof panels up 1 to 3 inches; immediately the center of the side panels are pushed inward while the lift bars are pulled down and additional force may be applied by pushing the front panel toward the bookcase. Once the shelter is completely collapsed, the latches are fastened to hold the shelter into place. The final step is to remove the lift bars from the shelter and store in designated location.

Figure 20:
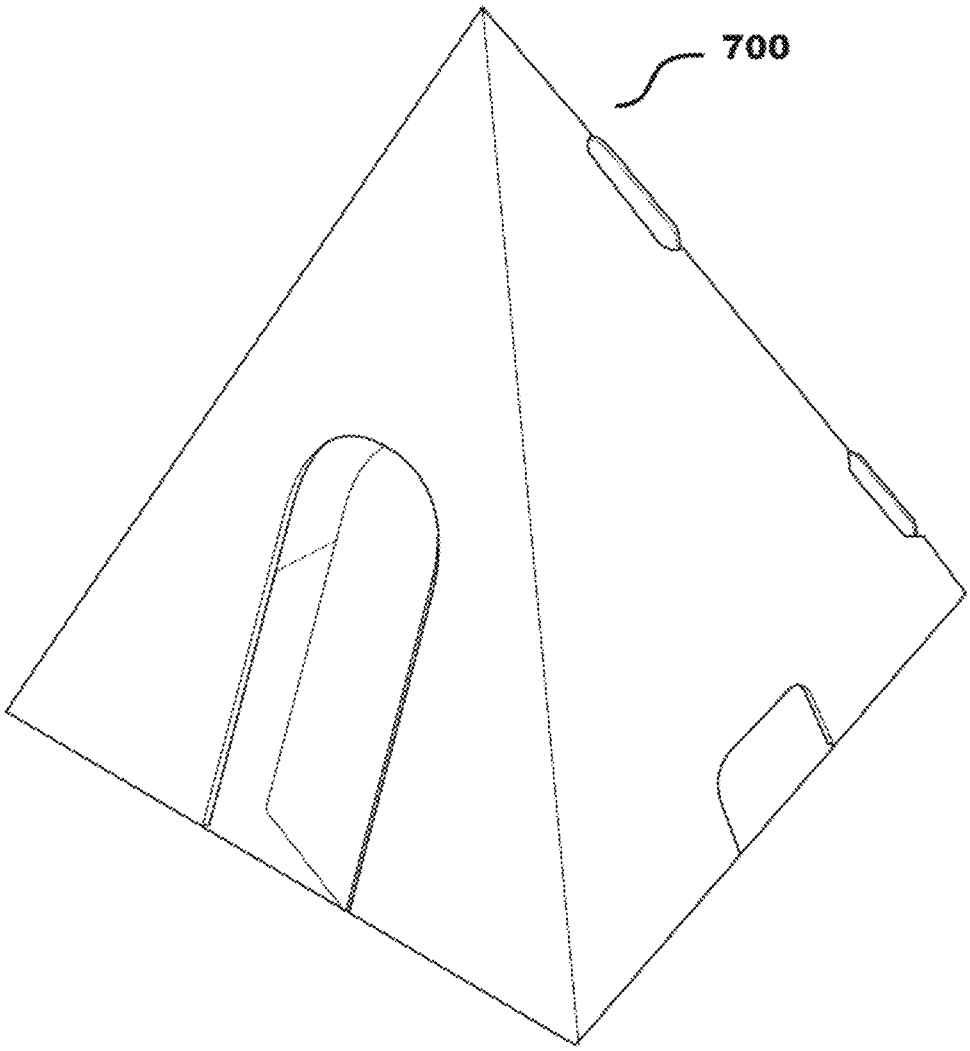
FIG. 20 shows an alternative embodiment of the current disclosure having a square pyramid structure.

While the shelters of the current disclosure are shown as cubed in shape, the current disclosure should to be so limited as shape does not restrict this disclosure nor limit the possible configurations of a collapsible structure as described herein. Indeed, polyhedron, prism, cone, n-orthotope, pyramids, oblong prisms, less-than-complete cubes, where the shelter would use at least one wall in an existing room to form at least one wall of the shelter, parallelograms, and other shapes are considered within the scope of this disclosure. Non-traditional shapes such as angled cylinders, cubes with a peaked roof, rectangular prisms with a peaked roof, octagon with a peaked roof, etc., are also considered within the scope of this disclosure. As FIG. 20 shows, a square pyramid structure 700, such as an angled tepee shape, is within the scope of this disclosure.

Figure 21:
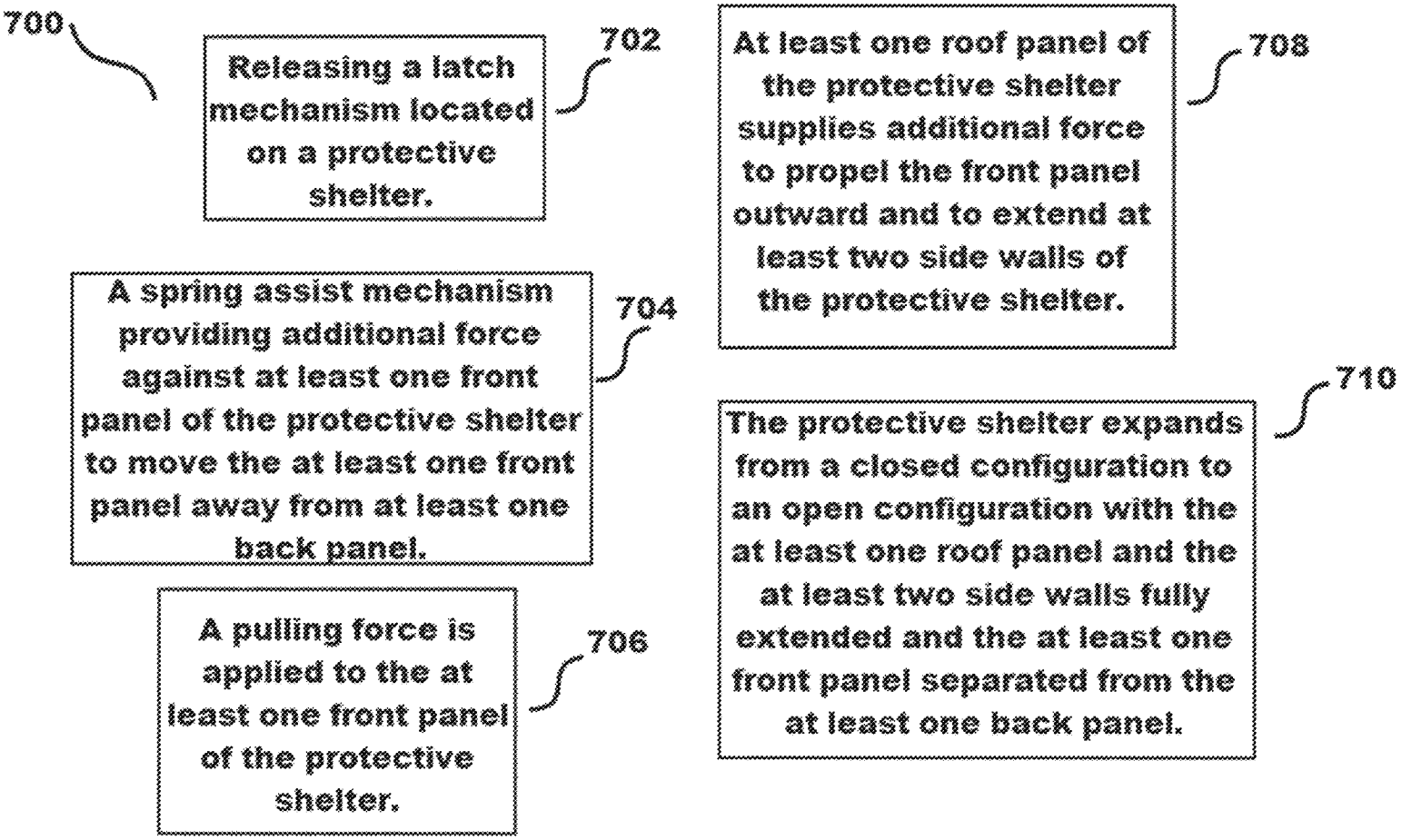
FIG. 21 shows a method of providing a protective shelter for occupants in a room.

FIG. 21 shows a method 700 of providing a protective shelter for occupants in a room. At step 702, a user releases a latch mechanism located on the protective shelter. At step 704, a spring assist mechanism provides additional force against a front panel of the protective shelter to move the at least one front panel away from the at least one back panel. At step 706, a pulling force is applied to the at least one front panel of the protective shelter. In one embodiment, this pulling force may be provided by a user but in other embodiments, an external force may be applied by placing or keeping the front panel under tension or by otherwise exerting a pulling force on the front panel as known to those of skill in the art. At step 708, at least one roof panel of the protective shelter supplies additional force to propel the at least one front panel outward and to extend at least two side wall panels of the protective shelter. At step 710, the protective shelter expands from a closed configuration to an open configuration with the at least one roof panel and the at least two side walls fully extended and the at least one front panel separated from the at least one back panel.

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art using the teachings disclosed herein.

What is claimed is:

1. A protective shelter comprising:

the protective shelter that reversibly moves between a closed configuration and an open configuration;

wherein the protective shelter in the open configuration includes:

at least two side walls formed from at least two joined side wall sections;

at least one roof formed from at least two joined roof sections wherein the at least two joined roof sections are positioned substantially vertically in the closed configuration and substantially horizontally in the open configuration;

at least one dampener affixed to an upper surface of at least one of the two joined roof sections wherein the dampener controls movement of the at least two joined roof sections as the at least two joined roof sections overcome a coefficient of friction as the protective shelter is moved from the closed configuration to the open configuration;

at least one back panel; and at least one front panel defining an entry access.

2. The protective shelter of claim 1, wherein the protective shelter further includes at least one hydraulic damper to reduce an opening force associated with moving the protective shelter from the closed configuration to the open configuration.

3. The protective shelter of claim 1, further comprising at least one spring assist device that applies forces to at least the front panel to assist the protective shelter moving from the closed configuration to the open configuration.

4. The protective shelter of claim 1, wherein the at least two side walls, the at least one back panel, and the at least one front panel are formed from ballistic material.

5. The protective shelter of claim 1, wherein at least one floor plate is affixed to a floor supporting the protective shelter and the at least one floor plate is affixed to the at least one back panel.

6. The protective shelter of claim 1, wherein the at least two joined side wall sections are joined via hinges.

7. The protective shelter of claim 1, wherein the at least two joined side wall sections extend and retract via movement of rollers or ball assemblies affixed to the joined wall sections.

8. The protective shelter of claim 7, wherein the rollers or ball assemblies move in an arcuate manner atop the at least one floor.

9. The protective shelter of claim 1, wherein a cabinet is affixed to the at least one back panel.

10. The protective shelter of claim 9, wherein the cabinet includes at least a communications console for allowing occupants of the protective shelter to communicate externally.

11. The protective shelter of claim 1, wherein multiple shelters are conjoined to form a single, larger protective shelter.

12. A method of providing a protective shelter for occupants in a room including:

releasing a latch mechanism located on the protective shelter;

a spring assist mechanism providing a force against at least one front panel of the protective shelter to move the front panel away from at least one back panel;

wherein at least one roof panel of the protective shelter is formed from at least two joined roof sections and supplies a force to propel the front panel outward and to extend at least two side walls of the protective shelter via the at least one roof panel being positioned substantially vertically above the at least one front panel and the at least one back panel and movement of the at least one roof panel from a substantially vertical position to a substantially horizontal position; and expanding the protective shelter from a closed configuration to an open configuration wherein the at least one roof panel and the at least two side walls are fully extended and the at least one front panel is separated from the at least one back panel; and arresting movement of the at least one roof panel via at least one dampener affixed to an upper surface of at least one roof panel wherein the dampener controls movement of the at least one roof panel as the at least one roof panel overcomes a coefficient of friction as the protective shelter is moved from the closed configuration to the open configuration.

13. The method of claim 12, wherein the protective shelter includes an entry in the front panel, which is opened to allow occupants to enter the protective configuration in an open configuration.

14. The method of claim 12, wherein at least the two side walls, the at least one back panel, and the at least one front panel are formed from ballistic material.

15. The method of claim 12, wherein the at least two side walls extend and retract via movement of rollers or ball assemblies affixed to the at least two side walls.

16. The method of claim 15, wherein the rollers or ball assemblies move in an arcuate manner atop a floor plate.

17. The method of claim 12, wherein a cabinet is affixed to the at least one back panel.

18. The method of claim 12, wherein the cabinet includes at least a communications console for allowing occupants of the protective shelter to communicate externally.

* * * * *